US011098919B2

(12) United States Patent
Nabeshima et al.

(10) Patent No.: US 11,098,919 B2
(45) Date of Patent: Aug. 24, 2021

(54) AIR CONDITIONING SYSTEM

(71) Applicant: Daikin Industries, LTD., Osaka (JP)

(72) Inventors: Norihiro Nabeshima, Osaka (JP); Akio Tasaka, Osaka (JP); Yuusuke Shiono, Osaka (JP); Makoto Ikeda, Osaka (JP); Atsushi Matsubara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 5 days.

(21) Appl. No.: 16/490,969

(22) PCT Filed: Apr. 11, 2018

(86) PCT No.: PCT/JP2018/015210
§ 371 (c)(1),
(2) Date: Sep. 4, 2019

(87) PCT Pub. No.: WO2018/193931
PCT Pub. Date: Oct. 25, 2018

(65) Prior Publication Data

US 2020/0033018 A1 Jan. 30, 2020

(30) Foreign Application Priority Data

Apr. 18, 2017 (JP) ..... JP2017-082092

(51) Int. Cl.
*F24F 11/46* (2018.01)
*F24F 11/65* (2018.01)
(Continued)

(52) U.S. Cl.
CPC ..... *F24F 11/46* (2018.01); *F24F 1/08* (2013.01); *F24F 1/14* (2013.01); *F24F 11/65* (2018.01)

(58) Field of Classification Search
CPC .. F24F 11/46; F24F 11/65; F24F 11/30; F24F 11/67; F24F 1/14; F24F 1/46; F24F 1/60;
(Continued)

(56) References Cited

U.S. PATENT DOCUMENTS 5,987,908 A 11/1999 Wetzel
9,459,014 B2 * 10/2016 Hattori ..... F24F 11/30
(Continued)

FOREIGN PATENT DOCUMENTS

GB 2516577 A 1/2015
JP 48-002756 A 1/1973
(Continued)

OTHER PUBLICATIONS

Form PCT/IB/338 of PCT/JP2018/015210 dated Oct. 31, 2019.
Form PCT/IB/373—International Preliminary Report on Patentability of PCT/JP2018/015210 dated Oct. 22, 2019.

*Primary Examiner* — Marc E Norman
(74) *Attorney, Agent, or Firm* — Birch, Stewart, Kolasch & Birch, LLP

(57) ABSTRACT

In an air conditioning system which conditions air in one air-conditioning-target space with a plurality of air conditioners each including a compressor, the energy consumption efficiency as a whole is improved. The air conditioners (21 to 29) each include a service-side heat exchanger exchanging heat between air of a room which is the air-conditioning-target space and a refrigerant, a heat-source-side heat exchanger exchanging heat between air of a common space and the refrigerant, and a compressor (41 to 49) compressing the refrigerant circulating through the service-side heat exchanger and the heat-source-side heat exchanger. When an air conditioning capacity falls within a predetermined range for at least two of the plurality of air
(Continued)

conditioners (21 to 29), part of the air conditioners whose compressors are in operation has its compressor stopped.

15 Claims, 10 Drawing Sheets

(51) Int. Cl.
*F24F 1/08* (2011.01)
*F24F 1/14* (2011.01)

(58) Field of Classification Search
CPC .... F24F 13/08; F24F 2110/00; F24F 2110/10; F24F 2110/30; F25B 49/022; F25B 5/00; F25B 6/00; F25B 2600/11
See application file for complete search history.

(56) References Cited

U.S. PATENT DOCUMENTS

| | | | | |
|---|---|---|---|---|
| 10,088,211 | B2 * | 10/2018 | Unezaki | G05D 23/1932 |
| 10,422,547 | B2 * | 9/2019 | Hamada | F24F 11/89 |
| 10,739,027 | B2 * | 8/2020 | Abiprojo | G05B 19/042 |
| 2010/0125370 | A1 | 5/2010 | Baba et al. | |
| 2013/0319018 | A1 | 12/2013 | Lim et al. | |

FOREIGN PATENT DOCUMENTS

| | | | |
|---|---|---|---|
| JP | 09-060922 | A | 3/1997 |
| JP | 2003-65588 | A | 3/2003 |
| JP | 2007-271112 | A | 10/2007 |
| JP | 2010-14364 | A | 1/2010 |
| JP | 2010-121798 | A | 6/2010 |
| JP | 2012-117699 | A | 6/2012 |

* cited by examiner

AIR CONDITIONING SYSTEM

TECHNICAL FIELD

The present invention relates to an air conditioning system, particularly to an air conditioning system exchanging, in order to condition air of indoor air-conditioning-target space, heat with air of common space which is disposed indoors around the air-conditioning-target space and which is not a target of air conditioning.

BACKGROUND ART

Conventionally, there is proposed an air conditioning system which employs a plurality of small integral air conditioners configured to condition air using indoor common space such as an attic which is not the target of the air conditioning. For example, Patent Literature 1 (Japanese Unexamined Patent Application Publication No. 48-2756) discloses an integral air conditioner which has an air-conditioning heat exchanger and a heat-dissipating heat exchanger for carrying out a refrigeration cycle both disposed indoors, specifically at the boundary between the attic and the ceiling. The air of common space is used in heat exchange carried out by a plurality of heat-dissipating heat exchangers of a plurality of integral air conditioners.

SUMMARY OF THE INVENTION

Technical Problem

In the air conditioning system disclosed in Patent Literature 1, a plurality of integral air conditioners operate individually. Therefore, while the energy consumption efficiency of each of the integral air conditioners may be improved, the energy consumption efficiency of the plurality of integral air conditioners as a whole is susceptible to improvement.

An object of the present invention is to improve, in an air conditioning system which conditions air in one air-conditioning-target space with a plurality of air conditioners each including a compressor, the energy consumption efficiency as a whole.

Solution to Problem

An air conditioning system according to a first aspect of the present invention is an air conditioning system configured to exchange, in order to condition air of one indoor air-conditioning-target space, heat with air of a common space which is disposed indoors around the air-conditioning-target space and which is not a target of the air conditioning, the air conditioning system including a plurality of air conditioners each including: a service-side heat exchanger configured to exchange heat between air of the air-conditioning-target space and refrigerant; a heat-source-side heat exchanger configured to exchange heat between the air of the common space and the refrigerant; and a compressor configured to compress the refrigerant circulating through the service-side heat exchanger and the heat-source-side heat exchanger. When an air conditioning capacity falls within a predetermined range for at least two of the plurality of air conditioners, part of the air conditioners whose compressors are in operation has its compressor stopped.

With the air conditioning system according to the first aspect, when the air conditioning capacity falls within a predetermined range for at least two of the plurality of air conditioners, part of the air conditioners whose compressors are in operation has its compressor stopped. Thus, the number of air conditioners whose compressors are in operation is reduced, whereby the air conditioning capacity of the plurality of air conditioners as a whole is prevented from becoming redundant relative to the whole air conditioning load. This reduces an unwanted increase in the power consumption.

An air conditioning system according to a second aspect of the present invention is the air conditioning system according to the first aspect in which, when the air conditioning capacity falls within the predetermined range for at least two of the plurality of air conditioners, the air conditioner whose compressor is still in operation has an operating frequency of is compressor raised to an operating at which excellent energy consumption efficiency of the plurality of air conditioners is attained.

With the air conditioning system according to the second aspect, the operating frequency of the in-operation compressor is raised to the frequency at which excellent energy consumption efficiency of the plurality of air conditioners is attained. Thus, the operating frequency of the compressors is adjusted for better energy consumption efficiency.

An air conditioning system according to a third aspect of the present invention is the air conditioning system according to the first or second aspect in which, when the air conditioning capacity falls within the predetermined range for at least two of the plurality of air conditioners, the air conditioner whose compressor is still in operation has an operating frequency of its compressor adjusted so as to reduce total power consumption of the compressors still in operation.

With the air conditioning system according to the third aspect, the operating frequency of the in-operation compressors is adjusted so as to reduce their total power consumption. This reduces power consumption of the plurality of air conditioners.

An air conditioning system according to a fourth aspect of the present invention is the air conditioning system according to any one of the first to third aspects in which, when the air conditioning capacity falls within the predetermined range for at least two of the plurality of air conditioners, the air conditioner whose compressor is still in operation has an operating state of the air conditioners changed so as to reduce a temperature change around the air conditioner whose compressor is still in operation.

With the air conditioning system according to the fourth aspect, the air conditioners whose compressor is still in operation has an operating state of the air conditioner changed so as to reduce a temperature change around the air conditioner. This reduces excessive cooling (heating) largely deviating from vicinity of the set temperature around the air conditioners whose compressors are in operation.

An air conditioning system according to a fifth aspect of the present invention is the air conditioning system according to the fourth aspect in which, when the air conditioning capacity falls within the predetermined range for at least two of the plurality of air conditioners, the air conditioner whose compressor is still in operation has at least one of an air flow orientation and air velocity of the air conditioner changed so as to reduce a temperature change around the air conditioner whose compressor is still in operation.

With the air conditioning system according to the fifth aspect, the air conditioner whose compressor is still in operation has at least one of the air flow orientation and air velocity of the air conditioner changed so as to reduce a temperature change around the air conditioner whose compressor is still in operation. This reduces the uneven temperature distribution attributed to the stoppage of part of the compressors.

An air conditioning system according to a sixth aspect of the present invention is the air conditioning system according to the fourth or fifth aspect in which, when the air conditioning capacity falls within the predetermined range for at least two of the plurality of air conditioners, the air conditioner whose compressor is stopped is switched to perform a blowing operation.

With the air conditioning system according to the sixth aspect, the air conditioner whose compressor is stopped is switched to perform a blowing operation, so as to facilitate shifting of air in the air-conditioning-target space. This reduces the uneven temperature distribution attributed to the stoppage of part of the compressors.

An air conditioning system according to a seventh aspect of the present invention is the air conditioning system according to any one of the fourth to sixth aspects in which, when the air conditioning capacity falls within the predetermined range for at least two of the plurality of air conditioners, among the plurality of air conditioners, the air conditioner whose compressor is in operation and the air conditioner whose compressor is stopped are replaced by each other.

With the air conditioning system according to the seventh aspect, the air conditioner whose compressor is in operation and the air conditioner whose compressor is stopped are replaced by each other. Thus, the place with a smaller number of air conditioners in operation and the place with a greater number of air conditioners in operation are replaced by each other.

An air conditioning system according to an eighth aspect of the present invention is any one of the first to seventh aspects in which the plurality of air conditioners include a plurality of in-group air conditioners grouped to establish communication with one another. When the air conditioning capacity falls within the predetermined range for at least two of the plurality of air conditioners, the air conditioner whose compressor is to be stopped is selected through the communication among the plurality of in-group air conditioners.

With the air conditioning system according to the eighth aspect, the air conditioner is selected through the communication among the plurality of in-group air conditioners. Therefore, setting of the air conditioners for changing the number of the air conditioners for example newly adding an air conditioner to the air-conditioning-target space or removing an air conditioner from the grouped air conditioners can be simply performed by grouping.

Advantageous Effects of Invention

The air conditioning system according to the first aspect of the present invention improves the energy consumption efficiency of the air conditioning system as a whole.

The air conditioning system according to the second aspect of the present invention maximizes the effect of improving the energy consumption efficiency of the air conditioning system as a whole.

The air conditioning system according to the third aspect of the present invention reduces power consumption of the air conditioning system.

The air conditioning system according to the fourth aspect of the present invention improves the energy consumption efficiency of the air conditioning system as a whole while reducing a reduction in comfort.

The air conditioning system according to any one of the fifth, sixth, and seventh aspects of the present invention reduces the risk of excessive cooling or heating largely deviating from the set temperature around the air conditioners in operation.

The air conditioning system according to the seventh aspect of the present invention reduces the uneven temperature distribution attributed to the stoppage of part of the compressors.

The air conditioning system according to the eighth aspect of the present invention makes it easier to add or remove the air conditioners.

DESCRIPTION OF EMBODIMENT (1) General Configuration

Figure 1:
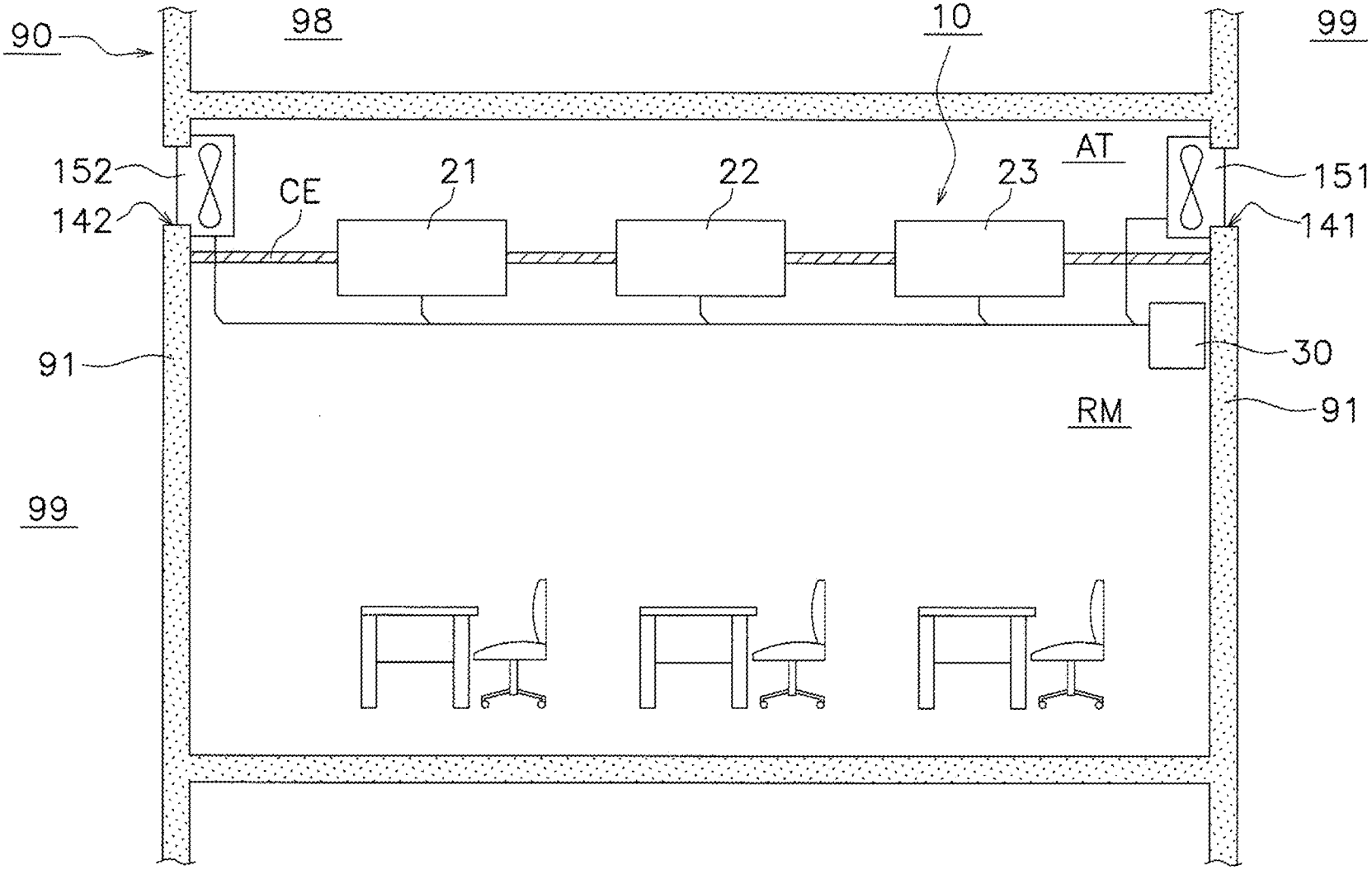
FIG. 1 is a schematic cross-sectional view of a building in which an air conditioning system according to an embodiment is installed.
Figure 2:
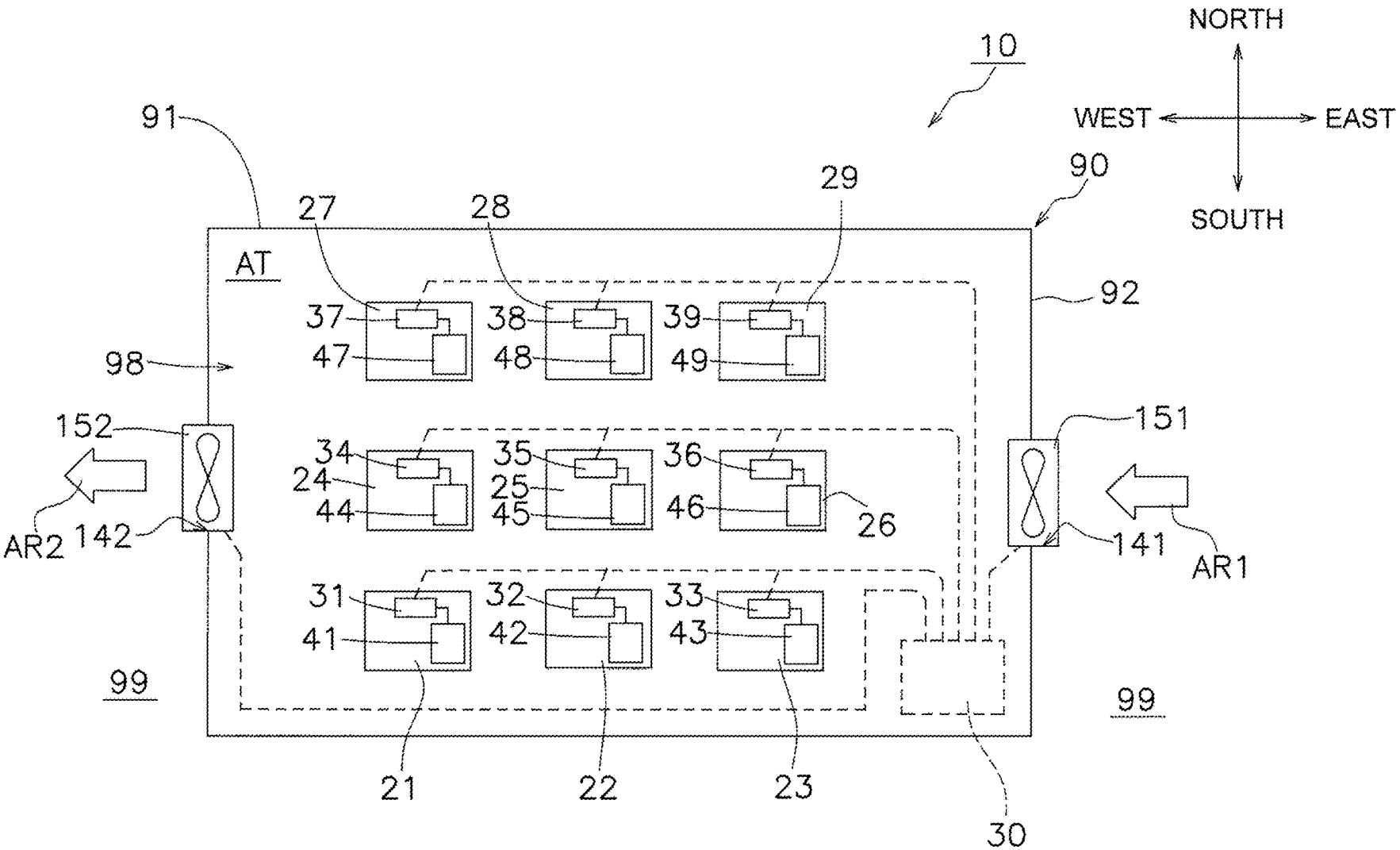
FIG. 2 is a schematic plan view of the building in which the air conditioning system according to the embodiment is installed.

With reference to FIGS. 1 and 2, a description will be given of an air conditioning system according to one embodiment of the present invention. In order to condition air of a room RM which is one air-conditioning-target space in an indoor area 98, an air conditioning system 10 shown in FIGS. 1 and 2 exchanges heat with air of an attic AT, which is common space disposed in the indoor area 98 around the room RM and which is not a target of air conditioning. The indoor area 98 is, for example, the inside of a building 90, and an outdoor area 99 is, for example, the outside of the building 90. Note that, for example, it is possible for one system control unit to control a plurality of air-conditioning-target spaces respectively corresponding to a plurality of common spaces independent of each other, such as an attic of the first floor in the building 90 and an attic of the second floor in the building 90. In this case, the system control unit exerts control while distinguishing between a plurality of air conditioners allotted to one air-conditioning-target space and other plurality of air conditioners allotted to other air-conditioning-target space. In the following, a description will be exemplarily given of the case where a system control unit controls a plurality of air conditioners allotted to one common space and one air-conditioning-target space.

Figure 3:
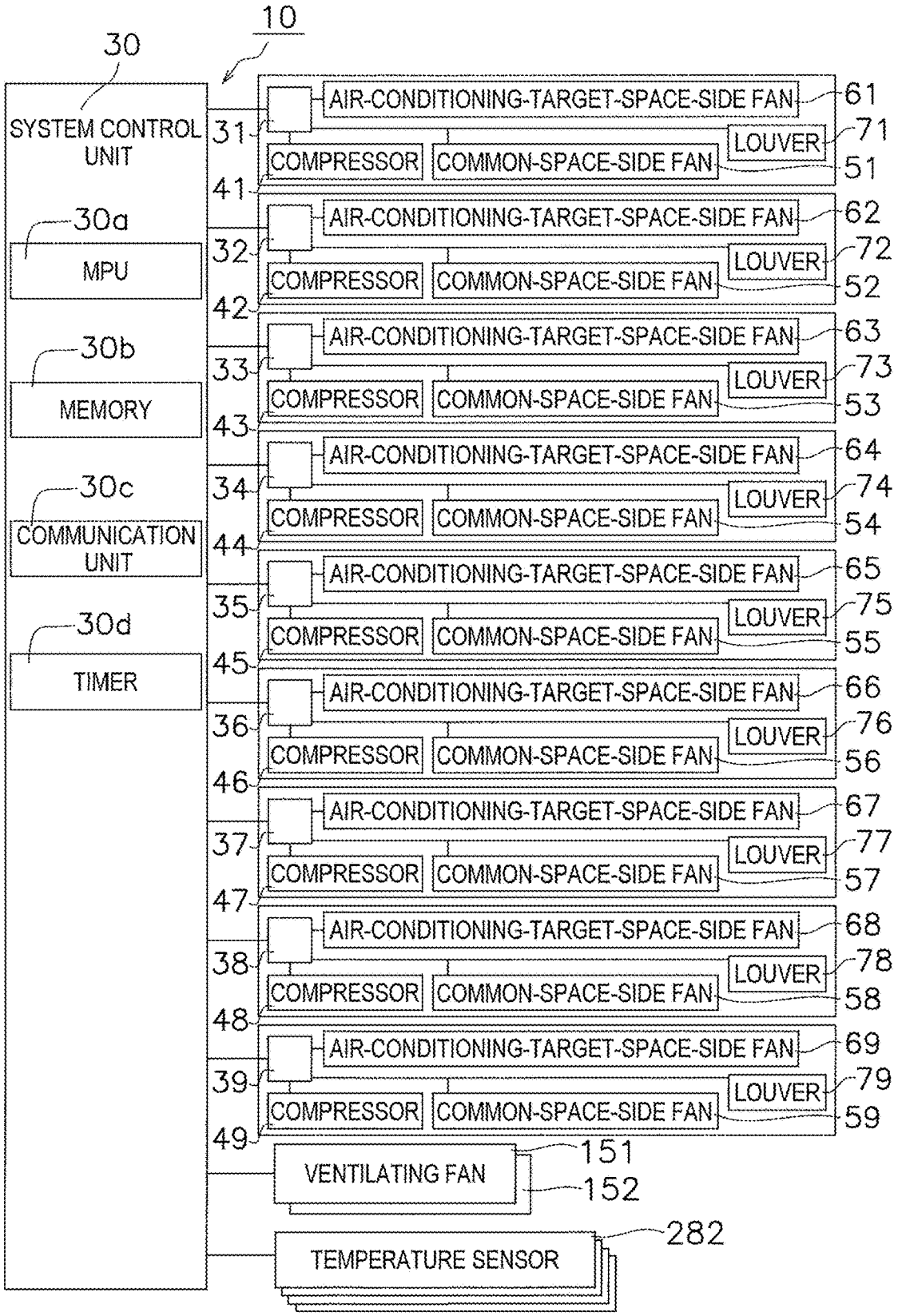
FIG. 3 is a block diagram of an exemplary air conditioning system according to the embodiment.

The air conditioning system 10 shown in FIGS. 1 and 2 includes a plurality of separate-type air conditioners 21 to 29 and a system control unit 30. FIG. 3 shows the overview of the relationship between the system control unit 30 and other constituents of the air conditioning system 10.

The nine air conditioners 21 to 29 are all controlled by the system control unit 30. Ventilating fans 151, 152 may also be controlled by the system control unit 30. The system control unit 30 communicates with device control units 31 to 39 respectively provided to the air conditioners 21 to 29 so as to control the air conditioners 21 to 29.

While detailed descriptions will be given later, in the air conditioners 21 to 29, a plurality of common-space-side heat exchangers 220 (see FIGS. 4 and 5) share air in the attic AT which is common space, in order to condition air of the air-conditioning-target space.

At a wall 91 of the building 90, an intake port 141 and an exhaust port 142 are formed. Outdoor air is taken in from the outdoor area 99 through the intake port 141, and the air in the attic AT is discharged to the outdoor area 99 through the exhaust port 142. Thus, the air in the attic AT and the outdoor air are replaced by each other and ventilation is provided. While FIG. 1 shows an exemplary case where ventilation of the attic AT is performed with one intake port 141 and one exhaust port 142, a plurality of intake ports 141 and a plurality of exhaust ports 142 may be provided. On the intake port 141 and the exhaust port 142, ventilating fans 151, 152 are mounted.

The ventilating fans 151, 152 are, for example, centrifugal fans, axial fans, or cross-flow fans. The ventilating fans 151, 152 may be driven by motors. The ventilating fans 151, 152 may have their on/off mode switched by the system control unit 30. Using the ventilating fans 151, 152 whose number of revolutions is variable, the system control unit 30 may change at least one of the volume and velocity of air taken in or discharged from the attic AT through the intake port 141 and the exhaust port 142.

The ventilating fans 151, 152 in operation generate air flows indicated by arrows AR1, AR2 in FIG. 2 which respectively flows in the attic AT through the intake port 141 and flows out from the attic AT to the outdoor area 99 through the exhaust port 142. As a result, in the attic AT, an air flow flowing from the intake port 141 to the exhaust port 142 is generated. Note that, one of the ventilating fans 151, 152 may be eliminated. For example, the ventilating fan 151 may be eliminated and just the ventilating fan 152 may be employed. In this case, according to generation of the air flow indicated by arrow AR2, negative pressure is generated in the attic AT, whereby an air flow (the air flow indicated by arrow AR1) flowing in the attic AT from the outdoor area 99 through the intake port 141 is generated.

(2) Configuration Details (2-1) Air Conditioners 21 to 29

While the air conditioners 21 to 29 may be different from one another in structure, they are similarly structured in the present embodiment. Accordingly, with reference to FIGS. 4 and 5, a description will be given exemplarily of the air conditioner 21 as a representative of the air conditioners 21 to 29.

The air conditioner 21 includes, in addition to the device control unit 31, a compressor 41, an air-conditioning-target-space-side heat exchanger 210, a common-space-side heat exchanger 220, a four-way switching valve 240, an expansion valve 250, an accumulator 260, a common-space-side fan 51, an air-conditioning-target-space-side fan 61, louvers 71, and a casing 300.

Similarly to the air conditioner 21, the air conditioners 22 to 29 each include, in addition to their respective device control units 32 to 39, the air-conditioning-target-space-side heat exchanger 210, the common-space-side heat exchanger 220, the four-way switching valve 240, the expansion valve 250, the accumulator 260, and the casing 300. The air conditioners 22 to 29 further respectively include compressors 42 to 49, common-space-side fans 52 to 59, air-conditioning-target-space-side fans 62 to 69, and louvers 72 to 79.

In the air conditioner 21, the air-conditioning-target-space-side heat exchanger 210 exchanges heat with air of the room RM which is the air-conditioning-target space. Heat is transferred between the common-space-side heat exchanger 220 and the air-conditioning-target-space-side heat exchanger 210. The common-space-side fan 51 allows the air taken in from the attic AT to flow toward the common-space-side heat exchanger 220 so that the air is again blown out in the attic AT. The air-conditioning-target-space-side fan 61 allows the air taken in from the room RM to flow toward the air-conditioning-target-space-side heat exchanger 210 so that the air is again blown out into the room RM.

The air-conditioning-target-space-side heat exchanger 210 and the common-space-side heat exchanger 220 in each of the air conditioners 21 to 29 can each be, for example, a fin-and-tube heat exchanger which exchanges heat between air passing through a multitude of fins (not shown) and refrigerant flowing through a plurality of heat transfer tubes (not shown) penetrating through the fins. Between the air-conditioning-target-space-side heat exchanger 210 and the common-space-side heat exchanger 220, heat is transferred by a refrigerant flowing through a refrigerant circuit 200.

Figure 4:
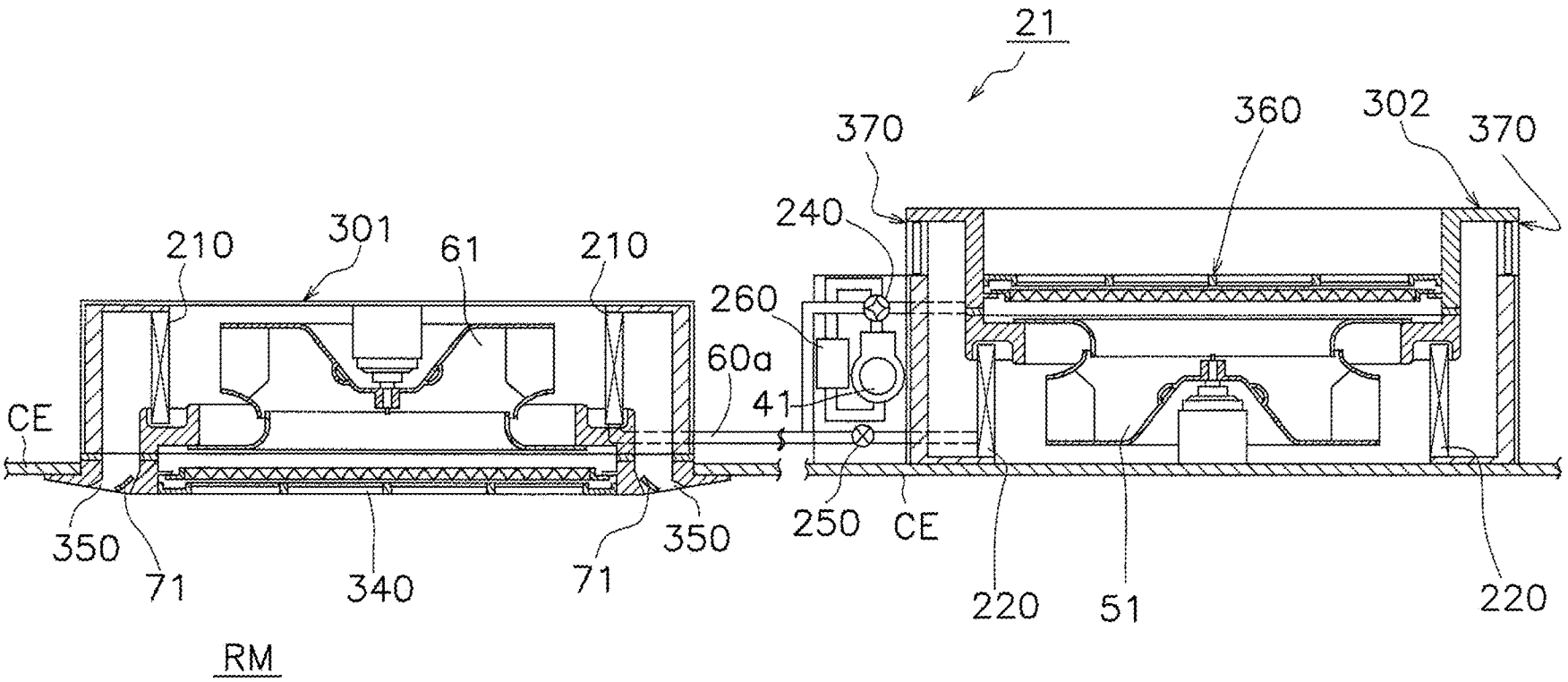
FIG. 4 is a schematic cross-sectional view of the air conditioner which forms the air conditioning system.

The common-space-side fan 51 and air-conditioning-target-space-side fan 61 of the air conditioner 21 can each be, for example, a centrifugal fan, an axial fan, or a cross-flow fan. As shown in FIG. 4, the common-space-side fan 51 and air-conditioning-target-space-side fan 61 of the air conditioner 21 are each a centrifugal fan. The number of revolutions of the common-space-side fan 51 and air-conditioning-target-space-side fan 61 shown here is variable. The common-space-side fans 52 to 59 and air-conditioning-target-space-side fans 62 to 69 of the air conditioners 22 to 29 are similar to the common-space-side fan 51 and air-conditioning-target-space-side fan 61 of the air conditioner 21. Accordingly, the system control unit 30 is capable of controlling the common-space-side blown-air volume and the air-conditioning-target-space-side blown-air volume (the velocity of air blown into the common space and the velocity of air blown into the air-conditioning-target space) flowing through the common-space-side fans 51 to 59 and air-conditioning-target-space-side fans 61 to 69 of the air conditioners 21 to 29 separately on the common-space side and the air-conditioning-target-space side. The system control unit 30 is also capable of controlling the air conditioners 21 to 29 independently of one another.

Figure 6:
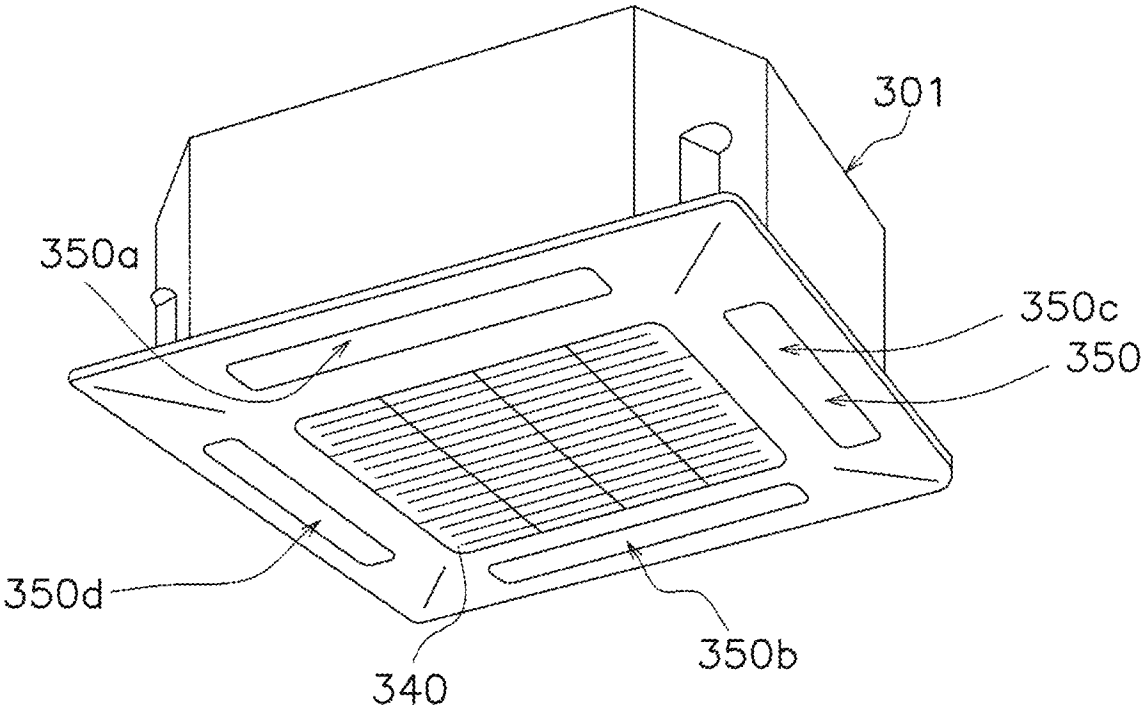
FIG. 6 is a perspective view of an exemplary first casing of the air conditioner in FIG. 4.

The louvers 71 of the air conditioner 21 are driven by a motor (not shown). The motor of the louvers 71 is controlled by the device control unit 31, and capable of changing the rotational angle. Thus, in response to an instruction from the system control unit 30, the louvers 71 are capable of changing the angle and hence the direction of blown air. The louvers 72 to 79 of the air conditioners 22 to 29 are similar to the louver 71 of the air conditioner 21. The louvers 72 to 79 are also capable of changing the direction of blown air in response to an instruction from the system control unit 30. As shown in FIG. 6, the air conditioners 21 to 29 each include four room-side blow-out ports 350*a* to 350*d*. At each of the four room-side blow-out ports 350*a* to 350*d*, corresponding one of the louvers 72 to 79 is disposed.

The separate-type air conditioner 21 includes two separate casing, namely, a first casing 301 and a second casing 302. At the bottom surface of the first casing 301 exposed to the room RM, a room-side suction port 340 for taking in air from the room RM and a room-side blow-out port 350 for blowing out air into the room RM are formed. At the second casing 302 exposed to the attic AT, a common-space-side suction port 360 for taking in air from the attic AT and a common-space-side blow-out port 370 for blowing out air into the attic AT are formed. The air-conditioning-target-space-side heat exchanger 210 and the common-space-side heat exchanger 220 may have a quadrangular annular shape so as to surround the common-space-side fan 51 and the air-conditioning-target-space-side fan 61. For example, the air-conditioning-target-space-side heat exchanger 210 has a quadrangular annular shape having four sides respectively corresponding to the four room-side blow-out ports 350 (350*a* to 350*d*) shown in FIG. 6.

Figure 5:
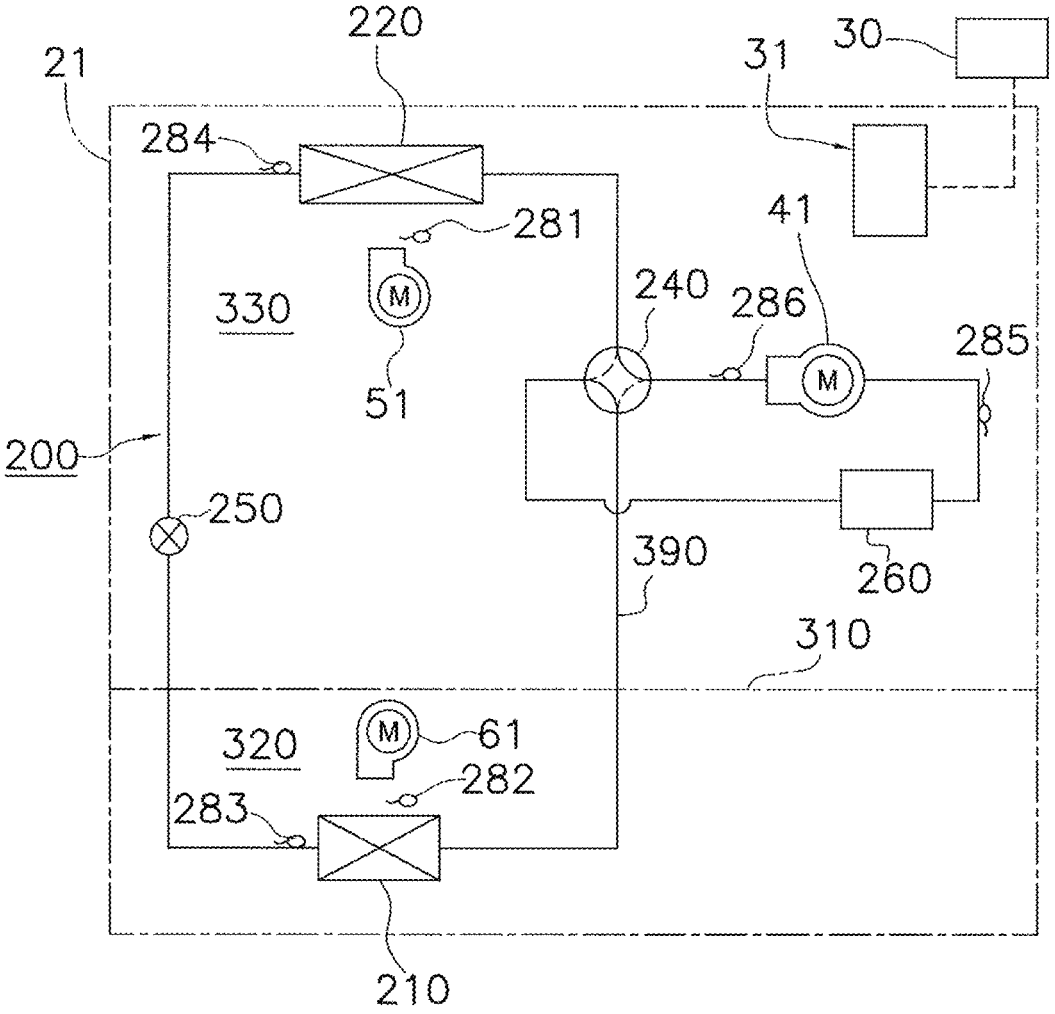
FIG. 5 is a circuit diagram of an exemplary refrigerant circuit of the air conditioner in FIG. 4.

FIG. 5 shows an exemplary refrigerant circuit 200. The refrigerant circuit 200 of the air conditioner 21 includes the compressor 41, the four-way switching valve 240, the common-space-side heat exchanger 220, the expansion valve 250, the air-conditioning-target-space-side heat exchanger 210, and the accumulator 260 connected to one another with a refrigerant pipe 390. In a cooling operation, the four-way switching valve 240 establishes the connection represented by the solid line, and the refrigerant discharged from the compressor 41 flows into the common-space-side heat exchanger 220 via the four-way switching valve 240. In the common-space-side heat exchanger 220, the refrigerant cooled by having exchanged heat with the air of the attic AT is expanded by the expansion valve 250, and flows into the air-conditioning-target-space-side heat exchanger 210. In the air-conditioning-target-space-side heat exchanger 210, the refrigerant heated by having exchanged heat with the air of the room RM is taken into the compressor 41 via the four-way switching valve 240 and the accumulator 260. In a heating operation, the four-way switching valve 240 establishes the connection represented by the broken line, and the refrigerant discharged from the compressor 41 flows into the air-conditioning-target-space-side heat exchanger 210 via the four-way switching valve 240. In the air-conditioning-target-space-side heat exchanger 210, the refrigerant cooled by having exchanged heat with the air of the room RM is expanded by the expansion valve 250, and flows into the common-space-side heat exchanger 220. In the common-space-side heat exchanger 220, the refrigerant heated by having exchanged heat with the air of the attic AT is taken into the compressor 41 via the four-way switching valve 240 and the accumulator 260.

The air conditioner 21 includes, for control purposes, temperature sensors 281 to 286. The temperature sensor 281 senses the temperature of the air of the attic AT before exchanging heat at the common-space-side heat exchanger 220. The temperature sensor 282 senses the temperature of the air of the room RM before exchanging heat at the air-conditioning-target-space-side heat exchanger 210. The temperature sensor 283 senses, between the expansion valve 250 and the air-conditioning-target-space-side heat exchanger 210, the temperature of the refrigerant at the passage of the air-conditioning-target-space-side heat exchanger 210. The temperature sensor 284 senses, between the expansion valve 250 and the common-space-side heat exchanger 220, the temperature of the refrigerant at the passage of the common-space-side heat exchanger 220. The temperature sensor 285 senses, between the accumulator 260 and the compressor 41, the temperature of the refrigerant taken into the compressor 41. The temperature sensor 286 senses, between the compressor 41 and the four-way switching valve 240, the temperature of the refrigerant discharged from the compressor 41. With the temperature sensors 281 to 286, the air conditioner 21 is controlled so that the degree of superheating of the refrigerant taken into the compressor 41 falls within a predetermined range, for example. Additionally, the air conditioner 21 is controlled so that the temperature of the refrigerant discharged from the compressor 41 becomes equal to or less than a predetermined value. In the refrigerant circuit 200 of the air conditioner 21, a refrigeration cycle, particularly a vapor compression refrigeration cycle, is carried out. The refrigerant circuit 200 of the air conditioners 22 to 29 is configured similarly to the refrigerant circuit 200 of the air conditioner 21 except that the compressor 41 is replaced by the compressors 42 to 49. The capacity of the compressors 41 to 49 of the air conditioners 21 to 29 is variable by varying the number of revolutions (the operating frequency).

(2-2) System Control Unit 30

As shown in FIG. 3, the system control unit 30 includes a micro processing unit (MPU) 30*a*, a memory 30*b*, a communication unit 30*c*, and a timer 30*d*. The system control unit 30 is connected to respective device control units 31 to 39 of the air conditioners 21 to 29. The system control unit 30 is also connected to the ventilating fans 151, 152. Information on the operating state of the air conditioners 21 to 29 is transmitted from the device control units 31 to 39 to the system control unit 30. Therefore, the system control unit 30 is capable of detecting whether or not each of the air conditioners 21 to 29 is in operation.

For example, the memory 30*b* of the system control unit 30 stores a program for controlling the operation of the air conditioning system 10 according to the embodiment described later. In accordance with the program stored in the memory 30*b*, the MPU 30*a* transmits an instruction to the device control units 31 to 39. While a description will be given of the case where the system control unit 30 is provided inside the building 90, the system control unit 30 may be provided outside the building 90. The storage function and processing function of the system control unit 30 may be provided at separate locations.

(3) Operation of Air Conditioning System 10 Relating to Compressor Stoppage According to Air Conditioning Capacity (3-1) Overview In a thermo-on state, in the air conditioners 21 to 29, the compressors 41 to 49 are in operation, to compress the refrigerant circulating through the air-conditioning-target-space-side heat exchanger 210 and common-space-side heat exchanger 220 of the air conditioners 21 to 29. The air-conditioning-target-space-side heat exchanger 210 of the air conditioners 21 to 29 exchanges, as a service-side heat exchanger, heat between the air of the room RM being the air-conditioning-target space and the refrigerant. The common-space-side heat exchanger 220 of the air conditioners 21 to 29 exchanges, as a heat-source-side heat exchanger, heat between the air of the attic AT and the refrigerant.

In a heating operation, when the indoor temperature becomes equal to or higher than a thermo-off temperature ($Ts+\alpha 1$ ($\alpha 1$ is a natural number)) slightly higher than a user-set set temperature Ts, a plurality of air conditioners 21 to 29 in a thermo-on state, i.e., having their compressors 41 to 49 operated, enter a thermo-off state, i.e., have their compressors 41 to 49 stopped. Additionally, in a heating operation, when the indoor temperature becomes equal to or lower than a thermo-on temperature (Ts−α2 (α2 is a natural number)) slightly lower than the user-set set temperature Ts, a plurality of air conditioners 21 to 29 in a thermo-off state, i.e., having their compressors 41 to 49 stopped, enter a thermo-on state, i.e., have their compressors 41 to 49 operated.

In a cooling operation, when the indoor temperature becomes equal to or lower than thermo-off temperature (Ts−β1 (β1 is a natural number)) slightly lower than the user-set set temperature Ts, a plurality of air conditioners 21 to 29 in a thermo-on state, i.e., having their compressors 41 to 49 operated, enter a thermo-off state, i.e., having their compressors 41 to 49 stopped. Additionally, in a cooling operation, when the indoor temperature becomes equal to or higher than a thermo-on temperature (Ts+β2 (β2 is a natural number)) slightly higher than the user-set set temperature Ts, a plurality of air conditioners 21 to 29 in a thermo-off state, i.e., having their compressors 41 to 49 stopped, enter a thermo-on state, i.e., have their compressors 41 to 49 operated.

Meanwhile, as the indoor temperature of the room RM which is the air-conditioning-target space approaches the set temperature, for example, if all the plurality of air conditioners 21 to 29 are in a thermo-on state, the air conditioning capacity of the air conditioning system 10 as a whole may become redundant.

Therefore, when the air conditioning capacity falls within a predetermined range for at least two of the air conditioners 21 to 29, the system control unit 30 stops part of the in-operation compressors 41 to 49 of the air conditioners 21 to 29. Hereinafter, such a stoppage of any air conditioner is referred to as the "compressor stoppage according to air conditioning capacity", and such a stoppage of any compressor is referred to as the "stop state according to air conditioning capacity".

More specifically, whether or not the air conditioning capacity falls within a predetermined range may be determined according to the operating frequency of the compressors 41 to 49 out of the factors determining the air conditioning capacity. That is, when the operating frequency of the compressors 41 to 49 for at least two of the plurality of air conditioners 21 to 29 falls within a predetermined range, the system control unit 30 stops part of the in-operation compressors 41 to 49 of the air conditioners 21 to 29. The period of the stoppage according to air conditioning capacity among the compressors 41 to 49 may be determined, for example, according to the timer 30*d* and the indoor temperature. A description will briefly be given of an exemplary configuration. An air conditioner in the stop state according to air conditioning capacity is once cancelled from the stop state according to air conditioning capacity when the indoor temperature exceeds the thermo-off temperature and a thermo-off state is entered. Here, the stop state according to air conditioning capacity of the air conditioner may not be immediately cancelled. In order to avoid such a situation, the timer 30*d* starts measuring time at a time point where the stop state according to air conditioning capacity is entered. When the stop state according to air conditioning capacity is not cancelled despite a lapse of a predetermined time, the system control unit 30 cancels the stop state according to air conditioning capacity in accordance with the elapsed time measured by the timer 30*d*. At the time point where the stop state according to air conditioning capacity is cancelled in accordance with the elapsed time measured by the timer 30*d*, the compressor of that air conditioner is stopped. Accordingly, a compressor is activated on condition that the indoor temperature is at the thermo-on temperature: that is, in a heating operation, the indoor temperature Tr is equal to or lower than the thermo-on temperature (Tr≤Ts−α2); in a cooling operation, the indoor temperature Tr is equal to or higher than the thermo-on temperature (Tr≥Ts+β2). Accordingly, at a time point where the stop state according to air conditioning capacity is cancelled, when the indoor temperature Tr is not at the thermo-on temperature, that is, when the indoor temperature Tr is higher than the thermo-on temperature (Tr>Ts−α2) in a heating operation; or when the indoor temperature Tr is lower than the thermo-on temperature (Tr<Ts+β2) in a cooling operation, the compressor stop state is maintained. Note that, the condition of cancelling the compressor stop state is not limited to the above-described manner, and may be determined for example just by the count value of the timer 30*d*, or the indoor temperature Tr. In determining by the indoor temperature Tr, the condition is not limited to exceeding the thermo-on temperature, and the indoor temperature Tr may be defined to satisfy any other condition.

(3-2) Load and Operating Frequency of Compression in Setting Indoor Temperature of Room RM to Set Temperature In the present embodiment, one set temperature Ts is set to one room RM, and the system control unit 30 controls nine air conditioners 21 to 29 so that the indoor temperature Tr of the room RM agrees with the set temperature Ts. For example, when the indoor temperature Tr for the nine air conditioners 21 to 29 detected by the temperature sensor 282 assumes values Tr1 to Tr9, in order to simplify control, the difference (Tra−Ts) between an average indoor temperature Tra which is the average of the indoor temperatures Tr1 to Tr9 and the set temperature Ts is considered as the load parameter for setting the room RM to the set temperature Ts. In a heating operation, when the average indoor temperature Tra of the room RM is lower than the set temperature Ts, thermal energy needs to be supplied from the air conditioners 21 to 29. As the average indoor temperature Tra is lower, the load for attaining the set temperature Ts becomes greater. Accordingly, when the average indoor temperature Tra is higher than the set temperature Ts, it is considered that substantially no load exists. In a cooling operation, when the average indoor temperature Tra of the room RM is higher than the set temperature Ts, thermal energy needs to be supplied from the air conditioners 21 to 29. As the average indoor temperature Tra is higher, the load for attaining the set temperature Ts becomes greater. When the average indoor temperature Tra is lower than the set temperature Ts, it is considered that substantially no load exists.

What is discussed herein is the case where control of narrowing distribution of the indoor temperature of the room RM is preferable for the user. There may be a case where the user prefers distributed indoor temperatures of the room RM. However, for the sake of clarity, the description will be given of the former case. In a heating operation, a lower average indoor temperature Tra means a greater load. Therefore, the operating frequency of each of the compressors 41 to 49 of the air conditioners 21 to 29 is greater. While the compressors 41 to 49 may be stopped when the indoor temperatures Tr1 to Tr9 detected at the air conditioners 21 to 29 attain the set temperature Ts, the thermo-off temperature is set to Ts+α1 so that the indoor temperature of the room RM can be controlled around the set temperature Ts.

Accordingly, as the indoor temperatures Tr1 to Tr9 approaches the thermo-off temperature (Ts+α1), the operating frequency of the compressors 41 to 49 reduces monotonously or reduces stepwise, and assumes 0 at the thermo-off temperature. In a cooling operation, as the indoor temperatures Tr1 to Tr9 approaches the thermo-off temperature (Ts−β1), the operating frequency of the compressors 41 to 49 reduces monotonously or reduces stepwise, and assumes 0 at the thermo-off temperature.

Desirably, the load (the cooling load or the heating load) when the indoor temperatures Tr1 to Tr9 attain the set temperature Ts and the air conditioning capacity of the air conditioners 21 to 29 agree with each other. Normally, such control is difficult and, therefore, feedback control is exerted and the indoor temperatures Tr1 to Tr9 fluctuate around the set temperature Ts. Generally, a smaller fluctuation width and a longer fluctuation period of the indoor temperatures Tr1 to Tr9 are likely to improve the energy consumption efficiency.

(3-3) Compressor Stoppage According to Air Conditioning Capacity

In a heating operation, when the average indoor temperature Tra is lower than the set temperature Ts and the temperature difference (Ts−Tra) between the set temperature Ts and the average indoor temperature Tra is great, in order to quickly realize the comfortable state for the user, the air conditioners 21 to 29 as many as possible are used to supply the maximum possible thermal energy. Here, the operating frequency of the compressors 41 to 49 is also great, and the compressor stoppage according to air conditioning capacity is not exerted. Similarly, in a cooling operation, when the average indoor temperature Tra is higher than the set temperature Ts and the temperature difference (Tra−Ts) between the set temperature Ts and the average indoor temperature Tra is great also, the compressor stoppage according to air conditioning capacity is not exerted.

When the temperature difference |Ts−Tra| between the set temperature Ts and the average indoor temperature Tra becomes smaller to establish the relationship of, for example, T2<|Ts−Tra|<T1, substantially equal air conditioning capacity is realized between the nine air conditioners 21 to 29 operating at a first operating frequency f1 and eight of the air conditioners 21 to 29 operating at a second operating frequency f2. Here, the following relationship is established: the first operating frequency f1<the second operating frequency f2.

Figure 7:
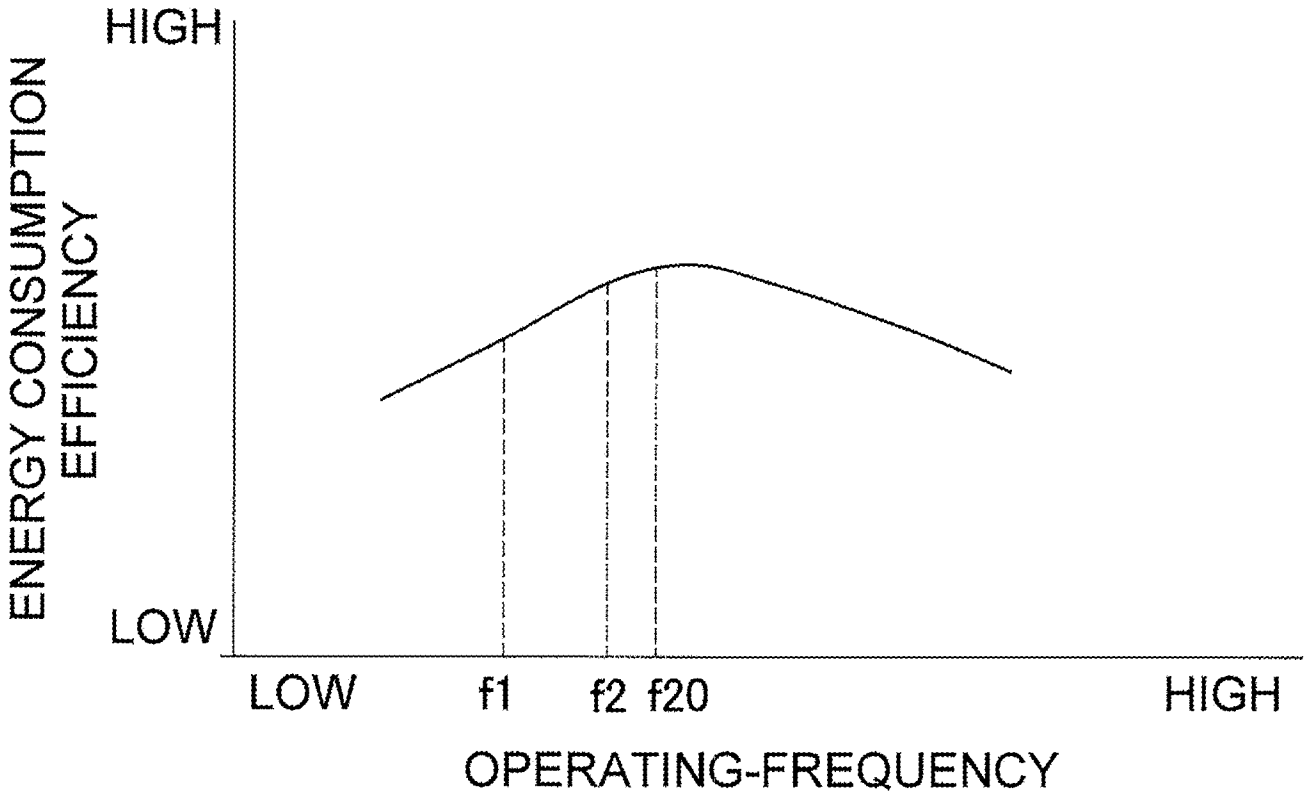
FIG. 7 is a graph explaining the relationship between the operating frequency and the energy consumption efficiency of the air conditioner.

In general, it is not that the energy consumption efficiency of an air conditioner is constant regardless of the operating frequency. For example, as shown in FIG. 7, the energy consumption efficiency of an air conditioner varies by the operating frequency. The air conditioners 21 to 29 have an operating frequency range where the energy consumption efficiency is excellent. In FIG. 7, in order to eliminate the effect of other factors such as the number of revolutions of the common-space-side fans 51 to 59, conditions other than the operating frequency are identical between the first operating frequency f1 and the second operating frequency f2. In exhibiting substantially identical air conditioning capacity, in some cases, eight air conditioners out of the air conditioners 21 to 29 operating at the second operating frequency f2 are better in the energy consumption efficiency than the air conditioners 21 to 29 operating at the first operating frequency f1. Accordingly, in such a case, from the state where the compressors 41 to 49 are in operation, one compressor is stopped, and eight air conditioners out of the air conditioners 21 to 29 are allowed to operate in the thermo-on state.

In some cases, the air conditioning capacity is substantially equal between eight air conditioners out of the air conditioners 21 to 29 in operation at a third operating frequency f3 and six air conditioners out of the air conditioners 21 to 29 in operation at a fourth operating frequency f4. Here, the following relationship is established: the third operating frequency f3<the fourth operating frequency f4. The energy consumption efficiency may be better when six air conditioners out of the air conditioners 21 to 29 are in operation than eight air conditioners out of the air conditioners 21 to 29 are in operation. Accordingly, in such a case, from the state where eight compressors out of the compressors 41 to 49 are in operation, two compressors are stopped, and six air conditioners out of the air conditioners 21 to 29 are allowed to operate in the thermo-on state.

The air conditioning capacity varies not just by the operating frequency of the compressors 41 to 49, but also by other factors such as the number of revolutions of the common-space-side fans 51 to 59. For example, in the case where one of the compressors 41 to 49 is to be stopped when nine air conditioners 21 to 29 are in operation, the system control unit 30 may calculate the air conditioning capacity of the nine air conditioners 21 to 29 and change the number of the compressors 41 to 49 in operation from nine to eight when the calculated air conditioning capacity falls within a predetermined range. On the other hand, since the compressors 41 to 49 are set to exhibit higher air conditioning capacity at a higher operating frequency and lower air conditioning capacity at a lower operating frequency, whether or not the air conditioning capacity falls within a predetermined range may simply be determined by the operating frequency of the compressors 41 to 49. In this case, part of the compressors 41 to 49 may be controlled to stop when the operating frequency of the compressors 41 to 49 falls within a predetermined range.

Not all the air conditioners 21 to 29 including in-operation compressors 41 to 49 may be considered in determining whether or not to stop the compressors according to air conditioning capacity. For example, two air conditioners 24, 26 out of the air conditioners 21 to 29 may be considered. When the air conditioning capacity of the air conditioners 24, 26 falls within a predetermined range, one of the air conditioners 24, 26 including in-operation compressors 44, 46 may have its compressor stopped.

When the air conditioners 21 to 29 are of the same type, the relationship between the operating frequency of the compressor and the energy consumption efficiency of the air conditioner is substantially the same. On the other hand, when the air conditioners 21 to 29 are of different types differing in the function of internal devices such as the compressors 41 to 49, the relationship between the operating frequency of the compressor and the energy consumption efficiency of the air conditioner is also different. Accordingly, any simulation and/or experiment is previously conducted, to previously determine which compressor is to be stopped when the air conditioning capacity of a certain air conditioner out of the air conditioners 21 to 29 falls within a predetermined range. This relationship is stored in the memory 30*b* as a table, for example.

For example, when the indoor temperature exceeds the thermo-off temperature and thus one of the nine air conditioners 21 to 29 enters a thermo-off state having its compressor stopped, since not all the nine air conditioners 21 to 29 have their compressors 41 to 49 in operation, whether or not the air conditioning capacity of the nine air conditioners 21 to 29 falls within a predetermined range is not determined. Here, for example, what is discussed herein is whether or not to stop any compressor is determined according to whether or not the air conditioning capacity of eight of the air conditioners 21 to 29 falls within a predetermined range. When one of the nine air conditioners 21 to 29 is in a thermo-off state and stopped, and eight air conditioners out of the air conditioners 21 to 29 are in a thermo-on state and therefore eight compressors out of the compressors 41 to 49 are in operation, whether or not the air conditioning capacity of the eight air conditioners out of the air conditioners 21 to 29 falls within a predetermined range is determined.

(3-4) Selection of Air Conditioner Whose Compressor is to be Stopped

For example, when the air conditioning capacity of nine air conditioners 21 to 29 falls within a predetermined range and the compressor of one air conditioner is to be stopped, the air conditioner whose compressor is to be stopped may be previously determined. For example, the memory 30*b* may previously store that the compressor 45 of the air conditioner 25 is to be stopped when the compressors 41 to 49 of nine air conditioners 21 to 29 are in operation and the air conditioning capacity falls within a predetermined range. It is preferable to select an air conditioner surrounded by many air conditioners such as the air conditioner 25 and stopping its compressor to enter a thermo-off state, than to select any of air conditioners surrounded by not many air conditioners such as the air conditioners 21, 23, 27, 29 and stopping corresponding compressor.

Furthermore, in the case where the air conditioning capacity of nine air conditioners 21 to 29 falls within a predetermined range and the compressor of one of the air conditioners is to be stopped, one of the air conditioners 21 to 29 may be selected according to the situation. Selecting one according to the situation may be, for example, selecting one of the air conditioners 21 to 29 whose indoor temperatures Tr1 to Tr9 detected by the temperature sensor 282 is nearest to the set temperature Ts. Causing the air conditioner with a smaller temperature difference between its ambient indoor temperature Tr and the set temperature Ts to enter a thermo-off state largely reduces uneven temperature distribution of the indoor temperature Tr, as compared to causing any air conditioner with a greater temperature difference between its ambient indoor temperature Tr and the set temperature Ts to enter a thermo-off state.

(3-5) Adjustment in Stopping Compressor

When the air conditioning capacity falls within a predetermined range for at least two of the plurality of air conditioners 21 to 29 and the compressor 49 is stopped, for example, the system control unit 30 exerts control of raising the frequency of the compressors 41 to 48 to the operating frequency at which excellent energy consumption efficiency of the air conditioners 21 to 28 is attained. That is, in this case, the operating frequency of the compressors 41 to 48 is raised from f1 to f2.

However, the air conditioning capacity may not be identical between before and after the compressor stoppage according to air conditioning capacity. Therefore, when an operating frequency f20 (see FIG. 7) slightly greater than the second operating frequency f2 can provide better energy consumption efficiency, the operating frequency f20 may be selected.

The operating frequency of the compressors may be adjusted as follows. When the compressor 49 is for example stopped according to air conditioning capacity, the operating frequency of the in-operation compressors 41 to 48 may be adjusted so as to reduce the total power consumption of the compressors 41 to 48. For example, in attaining air conditioning capacity of a similar degree, smaller total power consumption may be achieved by slightly raising the operating frequency of the compressor 41 and slightly reducing the operating frequency of the compressor 42 for difference in type among the compressors 41 to 48. In such a case, in stopping the compressor according to air conditioning capacity, the operating frequency of the compressor 41 is adjusted to be slightly greater than f2, and the operating frequency of the compressor 42 is adjusted to be slightly smaller than f2. Additionally, the operating frequency of the compressors may be adjusted so as to improve the energy consumption efficiency and to reduce the total power consumption of the compressors.

(3-6) Alleviating Unevenness in Indoor Temperature in Compressor Stoppage According to Air Conditioning Capacity When air conditioning capacity falls within a predetermined range for at least two of the plurality of air conditioners 21 to 29, for example, the operating state of the air conditioners 21 to 28 is changed so as to reduce changes in temperature around the air conditioners 21 to 28 whose compressors 41 to 48 are in operation. As described in the foregoing (3-3), when a compressor stoppage according to air conditioning capacity is executed, the air conditioning capacity of the air conditioners 21 to 28 whose compressors have not been the target of the compressor stoppage improves than before the execution of the stoppage. In FIG. 2, it is assumed that the orientation of the air flow flowing in the attic AT by the ventilating fans 151, 152 is from the east to the west. The air conditioner 29 whose compressor 49 is to be stopped will lose the air conditioning capacity. Hence, the northeast area in FIG. 2 may become difficult to reach the set temperature Ts than other area, while other area may show a great temperature change. Here, the operating state of the air conditioners 21 to 28 is changed so as to reduce temperature changes around the air conditioners 21 to 28 by minimizing the uneven temperature distribution. Specifically, at least one of the air flow orientation and air velocity of the air conditioners 21 to 28 may be changed.

(3-6-1) Changing Air Flow Orientation

For example, it is assumed that the louvers 71 at the room-side blow-out ports 350*a* to 350*d* of the air conditioners 21 to 28 are oriented downward before stoppage of the compressor 49 of the air conditioner 29 according to air conditioning capacity. When the compressor 49 of the air conditioner 29 is stopped in this state, the system control unit 30 changes upward the angle of louvers 71 at the room-side blow-out ports 350*a* to 350*d* of the air conditioners 21 to 28. For example, when the louvers 71 to 79 are driven by a stepper motor, the stepper motor changes the angle of the louvers 71 to 79 upward by a predetermined angle. That is, when the air conditioner 29 has its compressor stopped according to air conditioning capacity, the system control unit 30 orients upward or swings the air flow orientation of the air conditioners 21 to 28. As compared to the case where the air flow orientation is not changed, this reduces uneven indoor temperature distribution attributed to the compressor stoppage according to air conditioning capacity.

The air conditioner whose air flow orientation is to be changed in response to the compressor stoppage according to air conditioning capacity may be limited to, for example, the air conditioners 26, 28 located near the air conditioner 29 whose compressor is stopped. The air conditioners 26, 28 having the angle of their respective louvers 71 changed in this manner shifts air with a small temperature change around the air conditioner 29 to be mixed with air with a great temperature change. This reduces uneven indoor temperature distribution. When it is not desirable that the user becomes aware of the change in the air flow orientation, preferably the air conditioner whose air flow orientation is to be changed is limited. In order to exert such control of limiting the air conditioner whose air flow orientation is to be changed, the air conditioners 26, 28 located around the air conditioner 29 upon the stoppage of the compressor of the air conditioner 29 needs to be specified. In order to specify the air conditioners 26, 28 located around the air conditioner 29, the system control unit 30 stores on the memory 30*b* the positional information of the air conditioners 21 to 29 arranged in a matrix on north, south, east, and west orientations. When the stoppage of the compressor of the air conditioner 29 is determined, the system control unit 30 reads the positional information from the memory 30*b* and specifies the normal air conditioners 26, 28 located around the air conditioner 29. Such positional information is, for example, set on the system control unit 30 via the communication units 30*c* using a remote controller (not shown) in setting the air conditioners.

(3-6-2) Changing Air Velocity

For the sake of convenience in describing changing the air velocity, it is assumed that the air conditioners 21 to 29 each have three air velocity taps of "powerful", "medium", and "mild", in which "powerful" is fastest and "mild" is slowest. Changing air velocity is carried out by changing the number of revolutions of the air-conditioning-target-space-side fans 61 to 69. For example, it is assumed that the compressor of the air conditioner 29 is to be stopped according to air conditioning capacity. When the air velocity of the air conditioners 21 to 28 before the compressor stoppage according to air conditioning capacity is "mild", it is changed to "medium" after the stoppage of the compressor. This reduces uneven indoor temperature distribution attributed to the compressor stoppage according to air conditioning capacity, as compared to the case where no change in air velocity is made. The air conditioner whose air velocity is to be changed in response to the compressor stoppage according to air conditioning capacity may be limited to, for example, the air conditioners 26, 28 near the air conditioner 29 which has its compressor stopped. The air conditioners 26, 28 having the air velocity changed in this manner shifts air with a small temperature change around the air conditioner 29 to be mixed with air with a great temperature change. This reduces uneven indoor temperature distribution. When it is not desirable that the user becomes aware of the change in the air velocity, preferably the air conditioner whose air velocity is to be changed is limited. In order to exert such control of limiting the air conditioner whose air velocity is to be changed, the normal air conditioners 26, 28 located around the air conditioner 29 upon stoppage of the compressor of the air conditioner 29 needs to be specified. The method of specifying is similar to the above-described control of air flow orientation.

(3-7) Operations in Stoppage of Compressor (3-7-1) Switch to Blowing Operation

For example, as has been described above, the air conditioner 29 may be stopped when the compressor 49 of the air conditioner 29 enters the stop state according to air conditioning capacity. On the other hand, in the air conditioner 29, just the air-conditioning-target-space-side fan 69 which is smaller in power consumption than the compressor 49 may be driven to provide a blowing operation. The blowing operation may continue over the entire or part of the stoppage period of the compressor 49 according to air conditioning capacity. When the air conditioner 29 subjected to the compressor stoppage according to air conditioning capacity performs the blowing operation, the air conditioner 29 exchanges indoor air around the air conditioner 29 and air around the adjacent air conditioners 26, 28, for example, which reduces uneven temperature distribution.

(3-7-2) Replacing Air Conditioner Whose Compressor is to be Stopped According to Air Conditioning Capacity For example, as has been described above, when the compressor 49 of the air conditioner 29 enters the stop state according to air conditioning capacity and the compressors 41 to 49 of other air conditioners 21 to 28 are in operation, the air conditioner 29 in the compressor stop state according to air conditioning capacity may be replaced by other one of the air conditioners 21 to 28. The compressor 49 of the air conditioner 29 is stopped not by any failure of the air conditioner 29 but in an attempt to improve the energy consumption efficiency of the air conditioning system 10 as a whole. That is, midway through the stoppage, the air conditioner 29 may be caused to enter a thermo-on state, and for example the compressor 41 of the air conditioner 21 may be stopped, so that the air conditioner 21 enters in a thermo-off state. As described in the foregoing (3-1), in the case where the compressor stoppage according to air conditioning capacity is carried out until a predetermined time measured by the timer 30*d* elapses, in the earlier half of the predetermined time, the compressor 49 of the air conditioner 29 may be stopped to cause the air conditioner 29 to enter a thermo-off state and the air conditioner 21 may be cause to enter a thermo-on state; in the latter half of the predetermined time, the compressor 41 of the air conditioner 21 may be stopped to cause the air conditioner 21 to enter a thermo-off state and the air conditioner 29 may be caused to enter a thermo-on state.

(3-8) Specific Example of Control Flow

Figure 8:
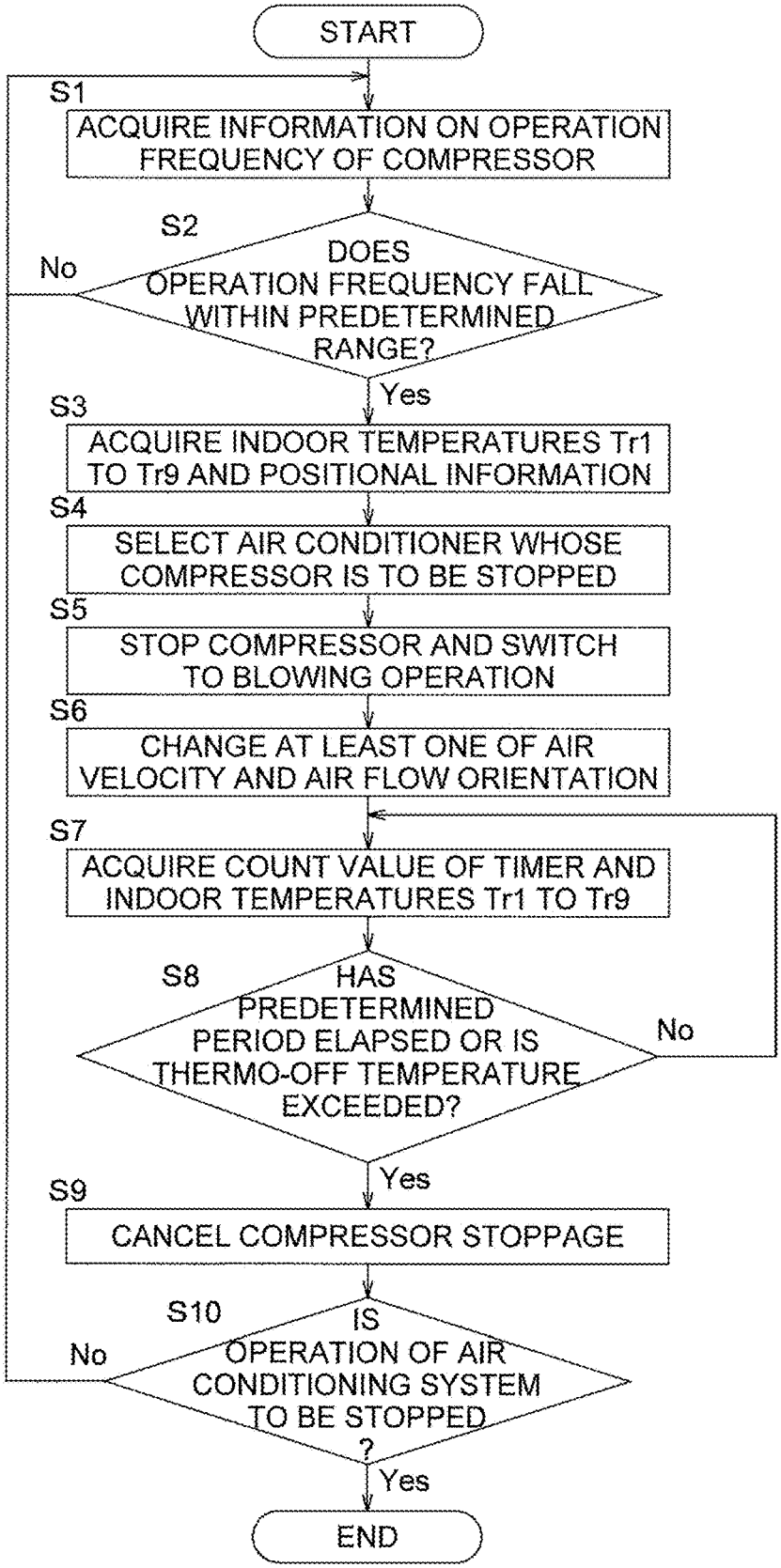
FIG. 8 is a flowchart of an exemplary operation of the air conditioning system according to the embodiment.

With reference to FIG. 8, a description will be given of a specific example of a control flow in stopping a compressor according to air conditioning capacity in the air conditioning system 10. Here, two out of eight air conditioners have their compressors stopped when the operating frequency of the compressors of the eight air conditioners falls within a predetermined range. The specific example of the control flow of the air conditioning system 10 herein is merely of an exemplary nature, and not intended to limit the technical scope of the present invention to this specific example.

The system control unit 30 acquires information on the operating frequency of the compressors 41 to 49 through communication with the device control units 31 to 39 of the nine air conditioners 21 to 29 of the same group shown in FIG. 2 (step S1).

Next, according to the information obtained from the device control units 31 to 39, the system control unit 30 determines whether or not the operating frequency of eight out of nine compressors 41 to 49 of the nine air conditioners 21 to 29 falls within a predetermined range (step S2). When the operating frequency of the eight compressors does not fall within a predetermined range, control returns to step S1. Until the operating frequency of eight compressors falls within a predetermined range, step S1 and step S2 are repeatedly performed, so as to monitor the air conditioners 21 to 29. While control proceeds to next step S3 in this example when the operating frequency of any eight out of compressors 41 to 49 of the nine air conditioners 21 to 29 falls within a predetermined range, it is also possible to employ a control flow in which the eight air conditioners are limited to, for example, air conditioners 21 to 24, 26 to 29. In the case where the determination is made for the eight whether or not the operating frequency falls within a predetermined range, it is also possible to determine whether or not the operating frequency falls within a predetermined range for in-operation eight compressors, when the indoor temperature at one of the nine compressors exceeds the thermo-off temperature and corresponding air conditioner is in a thermo-off state while the remaining eight air conditioners are in a thermo-on state and have their compressors operated.

When the operating frequency of the eight compressors falls within a predetermined range ("Yes" in step S2), the system control unit 30 reads the positional information of the air conditioners 21 to 29 from the memory 30*b* (step S3). The system control unit 30 acquires indoor temperatures Tr1 to Tr9 detected by the temperature sensor 282 through the device control units 31 to 39 (step S3).

According to the indoor temperatures Tr1 to Tr9 and the positional information, the system control unit 30 selects the air conditioner whose compressor is to be stopped. For example, when the indoor temperatures Tr1 to Tr6 out of the indoor temperatures Tr1 to Tr9 of the air conditioners 21 to 29 are close to the set temperature Ts, the system control unit 30 firstly selects the air conditioners 21 to 26 out of the air conditioners 21 to 29. Out of the selected air conditioners 21 to 26, the air conditioners 22, 25 surrounded by a greater number of air conditioners are selected (step S4).

Next, the compressors 42, 45 of the air conditioners 22, 25 selected in step S4 are stopped, and the air conditioners 22, 25 are switched to a blowing operation (step S5). The timer 30*d* of the system control unit 30 starts measuring time at the time point where the compressors 42, 45 of the air conditioners 22, 25 are stopped.

The system control unit 30 changes the air velocity and/or air flow orientation of the air conditioners 21, 23, 24, 26 to 29 in a thermo-on state (step S6). Here, for example, the air flow orientation and air flow orientation of the air conditioners 21, 23, 24, 26 to 29 are changed as described in the foregoing (3-6-1) and (3-6-1).

In step S7, the system control unit 30 acquires the count value of the timer 30*d* and the indoor temperatures Tr1 to Tr9. Then the system control unit 30 determines whether or not a predetermined period has elapsed after the time point where the compressors are stopped, and whether or not the average indoor temperature Tra exceeds the thermo-off temperature after the time point where the compressors are stopped (step S8). When a predetermined period has elapsed after the time point where the compressors are stopped and when the thermo-off temperature is exceeded after the time point where the compressors are stopped, control proceeds to step S9, and cancels the stoppage of the compressors of the air conditioners 22, 25 (step S9). When the air conditioning system 10 is to continuously operate, control returns to step S1 and repeatedly performs step S9 because again the condition of compressor stoppage may be satisfied (step S10).

(4) Variation (4-1) Variation 1A

In the embodiment, the description has been given of the case where the air conditioners 21 to 29 are of the separate type. Here, the air conditioners in the air conditioning system 10 may be integral air conditioners as shown in FIG. 9.

Here, the air conditioner 21 is exemplarily described. The integral air conditioner 21 according to variation 1A is largely different from the separate-type air conditioner 21 according to the embodiment in that the separate-type air conditioner 21 includes two separate casings, namely, a first casing 301 and a second casing 302, whereas the integral air conditioner 21 includes one casing 300 having its inner space partitioned by a partition 310.

In the casing 300 according to variation 1A, the partition 310 disposed inside divides the inner space into an air-conditioning-target-space-side section 320 and a common-space-side section 330. The bottom surface of the casing 300 exposed at the room RM is provided with a room-side suction port 340 for taking in air from the room RM and a room-side blow-out port 350 for blowing out air into the room RM. The top surface of the casing 300 exposed at the attic AT is provided with a common-space-side suction port 360 for taking in air from the attic AT and a common-space-side blow-out port 370 for blowing out air into the attic AT.

Figure 9:
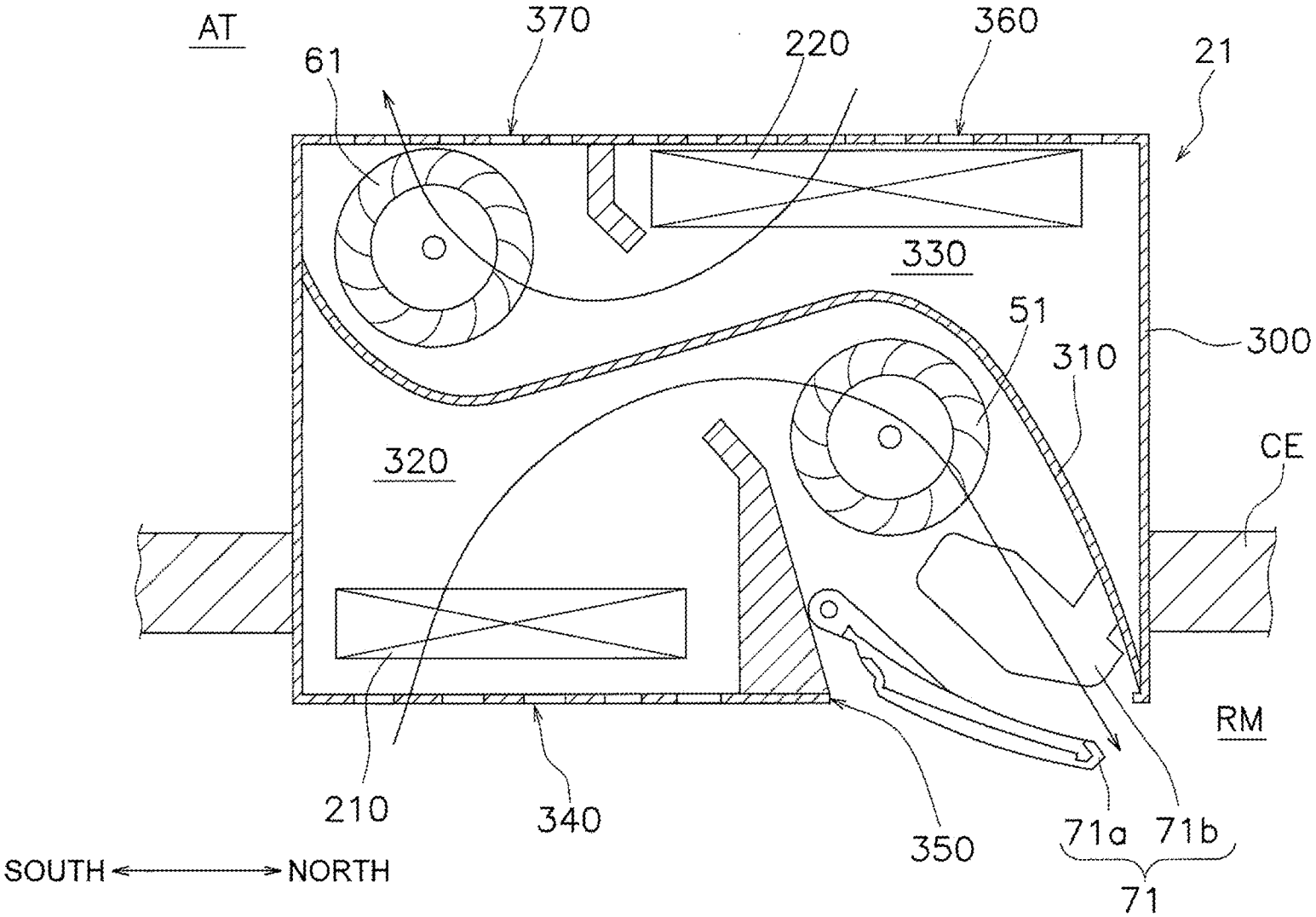
FIG. 9 is a schematic cross-sectional view of an air conditioner used in an air conditioning system according to variation 1A.

The common-space-side fan 51 and the air-conditioning-target-space-side fan 61 shown in FIG. 9 are each a cross-flow fan, for example. The air conditioner 21 shown in FIG. 4 includes, in addition to the device control unit 31, the compressor 41, the air-conditioning-target-space-side heat exchanger 210, the common-space-side heat exchanger 220, the four-way switching valve 240, the expansion valve 250, the accumulator 260, the common-space-side fan 51, the air-conditioning-target-space-side fan 61, the louver 71, and the casing 300. While the air conditioner 21 according to variation 1A includes similar elements, FIG. 9 showing the air conditioner 21 according to variation 1A does not show the device control unit 31, the compressor 41, the four-way switching valve 240, the expansion valve 250, and the accumulator 260. The louver 71 includes a vertical louver 71*a* and a horizontal louver 71*b*.

Since there exists a single room-side blow-out port 350 of the air conditioner 21 according to the variation 1A, the room-side blow-out port 350 of the air conditioner 21 is not very likely to be directed to the air conditioner whose has its compressor stopped. On the other hand, since the louver 71 of the air conditioner 21 according to the variation 1A includes the vertical louver 71*a* and the horizontal louver 71*b*, by adjusting the horizontal air flow orientation, the conditioned air can be blown toward the air conditioner having its compressor stopped.

A description will be given of changing the air flow orientation upon the compressor stoppage according to air conditioning capacity, assuming that the nine air conditioners 21 to 29 shown in FIG. 2 are each an integral air conditioner having its room-side blow-out port 350 oriented in the north. It is assumed that the compressor 44 of the air conditioner 24 has stopped according to air conditioning capacity. Before the stoppage of the compressor of the air conditioner 24, it is assumed that the horizontal louver 71*b* of the air conditioner 21 is for example adjusted to an angle for blowing conditioned air toward the center (toward the east) in the room RM. In this case, when the compressor 44 of the air conditioner 24 is stopped, for example, the horizontal louver 71*b* of the air conditioner 21 has its angle adjusted so as to blow conditioned air toward the air conditioner 24 (toward the north). When the compressor 44 of the air conditioner 24 is stopped, the angle of conditioned air blown according to the vertical louver 71*a* of the air conditioner 21 may be changed, for example, upward. The vertical louvers and the horizontal louvers included in the louvers 72, 73, 75 to 79 of the air conditioners 22, 23, 25 to 29 in addition to the air conditioner 21 may have their angle also changed upon stoppage of the compressor of the air conditioner 24, whereby the air flow orientation of the air conditioners 22, 23, 25 to 29 may be changed.

(4-2) Variation 1B

In the embodiment, the description has been given of the case where the system control unit 30 is provided outside the air conditioners 21 to 29. Here, the function of the system control unit 30 may be provided in the parent unit in the air conditioners 21 to 29. In this case, the subordinate units other than the parent unit and the parent unit in the air conditioners 21 to 29 may be grouped, to form a plurality of in-group air conditioners in which the air conditioners 21 to 29 can communicate with one another. In this case, the system control unit 30 in the parent unit specifies, through the communication among the plurality of in-group air conditioners, the air conditioner whose compressor is to be stopped and the air conditioner whose compressor is to be continuously operated among the plurality of in-group air conditioners.

Figure 10:
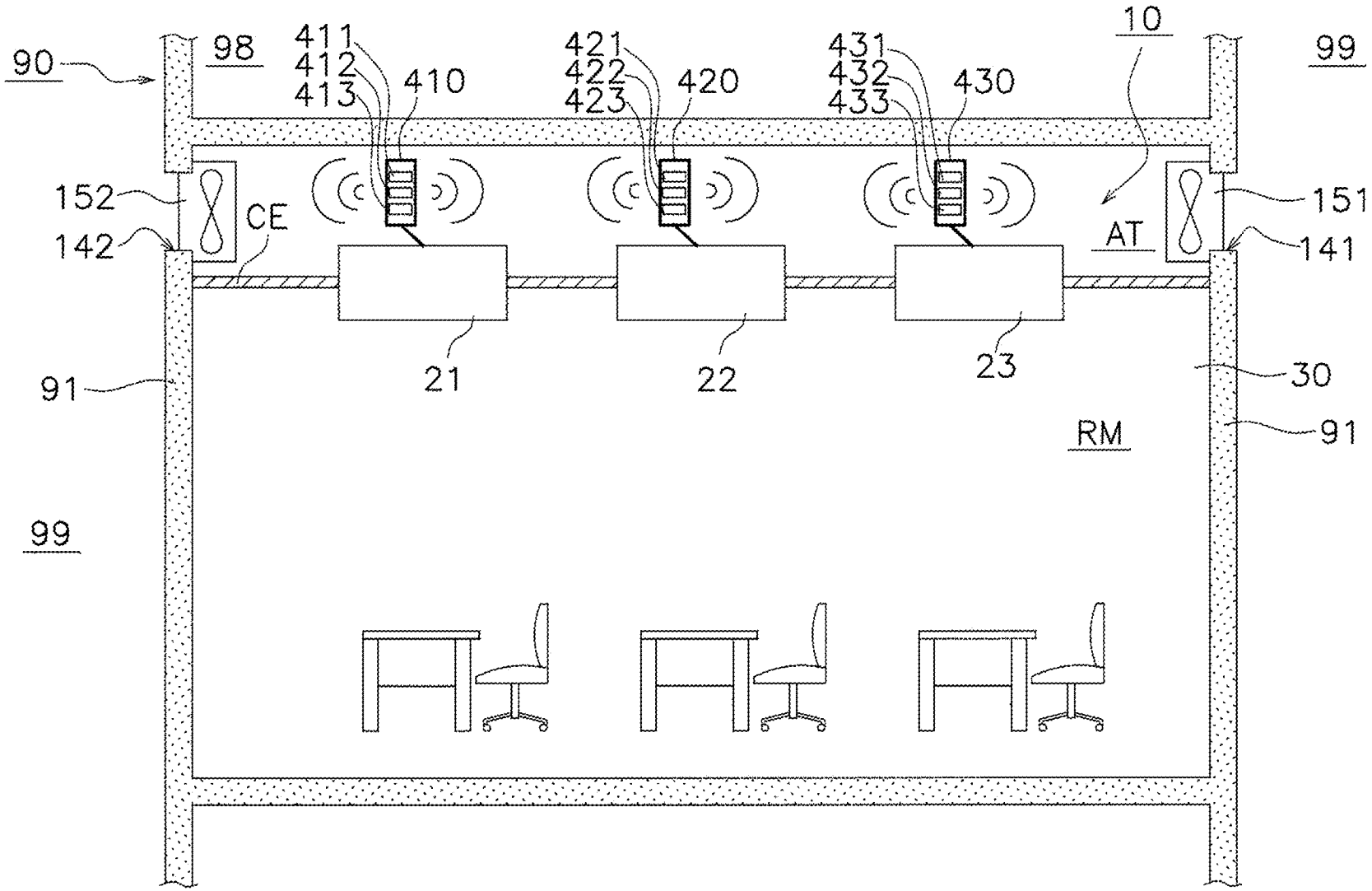
FIG. 10 is a schematic cross-sectional view of a building in which an air conditioning system according to variation 1B is installed.

This is not limited to integral control, and can be exerted as distributed control as shown in FIG. 10. In distributed control, for example, three air conditioners 21 to 23 forming the air conditioning system 10 each include, in place of the device control units 31 to 33, device control units 410, 420, 430. Similarly to the system control unit 30 including the MPU 30*a*, the memory 30*b*, and the communication unit 30*c*, the device control units 410, 420, 430 of the air conditioners 21 to 23 include MPUs 411, 421, 431, memories 412, 422, 432 and communication units 413, 423, 433. That is, a group of the device control units 410, 420, 430 functions as the system control unit. To this end, the device control units 410, 420, 430 are configured to communicate with one another. For example, when the compressor 41 of the air conditioner 21 is to be stopped according to air conditioning capacity, the air conditioner 21 issues, through the communication unit 413, information of stopping the compressor 41, and the air conditioners 22, 23 receive the information of stopping the compressor 41 through the communication units 423, 433. Using the MPUs 411, 421 and memories 412, 422, the air conditioners 22, 23 exert control similarly to the system control unit 30 exerting control using the MPU 30*a* and memory 30*b*. When the compressor 41 of the air conditioner 21 is stopped, for example, the air conditioner 22 disposed near the air conditioner 21 has at least one of its air velocity and air flow orientation changed according to the positional information so as to supplement a reduction in air conditioning function attributed to the stoppage of the compressor of the air conditioner 21. On the other hand, according to the positional information, the air conditioner 23 disposed far from the air conditioner 21 does not make such a change in at least one of its air velocity and air flow orientation.

While FIG. 10 shows just three air conditioners 21 to 23, distributed control can be exerted with nine air conditioners 21 to 29 as shown in FIG. 2. In this case, the air conditioners 21 to 29 are grouped to form a plurality of in-group air conditioners in which the air conditioners 21 to 29 can communicate with one another. The system control unit which is a group of the device control units of the air conditioners 21 to 29 specifies, through the communication among the plurality of in-group air conditioners, the air conditioner whose compressor is to be stopped and the air conditioner whose compressor is to be continuously operated among the plurality of in-group air conditioners.

(4-3) Variation 1C

In the embodiment, the description has been given of the case where all the air conditioners 21 to 29 have the set temperature identically set. Here, every ones of air conditioners 21 to 29 may have the set temperature individually set. In this case, the air conditioning load of the room RM is calculated for example as the sum of the air conditioning loads in the area where the air conditioners 21 to 29 are disposed.

(4-4) Variation 1D

With reference to FIG. 4, a description has been given of the case where heat is transferred between one common-space-side heat exchanger 220 and one air-conditioning-target-space-side heat exchanger 210 in one air conditioner 21. Here, in one air conditioner 21, a plurality of first casings 301 and corresponding elements stored therein may be provided, so that heat is transferred between one common-space-side heat exchanger 220 and a plurality of air-conditioning-target-space-side heat exchangers 210. In this case, the plurality of first casings 301 operate for conditioned air of identical space.

(4-5) Variation 1E

The flowchart of FIG. 8 does not show a step of replacing the air conditioner whose compressor is to be stopped after the compressor stoppage according to air conditioning capacity. Here, the step of replacing the air conditioner whose compressor is to be stopped described in the foregoing (3-7-2) may be inserted between, for example, step S7 and step S8.

(5) Characteristics (5-1)

As has been described above, in the air conditioning system 10, when the air conditioning capacity falls within a predetermined range for at least two of a plurality of air conditioners 21 to 29, part of the air conditioners has its in-operation compressor stopped. Thus, the number of air conditioners whose compressors are in operation is reduced, whereby the air conditioning capacity of the plurality of air conditioners 21 to 29 as a whole is prevented from becoming redundant relative to the whole air conditioning load. This minimizes an unwanted increase in the power consumption. As a result, this improves the energy consumption efficiency of the air conditioning system 10 as a whole.

For example, on how many air conditioners the determination of whether the air conditioning capacity falls within a predetermined range should be made, nine, eight, . . . , or two should be previously set. Any one of or some of such candidate numbers is employed. Furthermore, the number of the compressors to be stopped is not limited to one, and a plurality of compressors may be stopped.

(5-2)

For example, when the compressors 41 to 48 of the air conditioners 21 to 28 are in operation and the compressor 49 of the air conditioner 29 is stopped according to air conditioning capacity, as has been described with reference to FIG. 7, the operating frequency of the compressors 41 to 48 of the air conditioners 21 to 28 can be raised from the operating frequency f1 before the compressor stoppage to the operating frequency f2 or the operating frequency f20 which provides excellent energy consumption efficiency. Thus, the operating frequency of the compressors 41 to 48 is adjusted for better energy consumption efficiency. This adjustment in operating frequency maximizes the effect of improving the energy consumption efficiency of the air conditioning system 10 as a whole.

(5-3)

When the air conditioning capacity falls within a predetermined range for at least two of a plurality of air conditioners 21 to 29, part of the air conditioners 21 to 29 has its compressor stopped. Here, adjusting the operating frequency of the remaining in-operation compressors among the air conditioners 21 to 29 so as to reduce their total power consumption reduces the power consumption of the in-operation compressors as a whole. This adjustment in operating frequency reduces power consumption of the air conditioning system 10.

(5-4)

When the air conditioning capacity falls within a predetermined range for at least two of a plurality of air conditioners 21 to 29, part of the air conditioners 21 to 29 has its compressor, for example, the compressor 45, stopped. The loss in air conditioning capacity attributed to the stopped compressor 45 is supplemented by the remaining air conditioners 21 to 24, 26 to 29. In such a situation, the temperature change around the air conditioners 21 to 24, 26 to 29 whose compressors are in operation tends to become great. Here, the operating state of the air conditioners 21 to 24, 26 to 29 whose compressors are in operation is changed so as to reduce the temperature change around the air conditioners 21 to 24, 26 to 29 whose compressors are in operation. This minimizes excessive cooling (heating) largely deviating from the set temperature around the air conditioners 21 to 24, 26 to 29 whose compressors are in operation. This change in operating state of the air conditioners 21 to 24, 26 to 29 improves the energy consumption efficiency of the air conditioning system 10 as a whole while minimizing any reduction in comfort.

(5-5)

As one mode of the change in operating state described in the foregoing (5-4), changing at least one of the air flow orientation and air velocity of the air conditioners 21 to 24, 26 to 29 whose compressors are in operation so as to reduce the temperature change around the air conditioners 21 to 24, 26 to 29 whose compressors are in operation can reduce the uneven temperature distribution attributed to the stoppage of the compressor 45 which is the part of the compressors. For example, the air flow orientation of the air conditioners 21 to 24, 26 to 29 is changed so that a greater amount of conditioned air flows toward the air conditioner 25 and the air velocity is changed to be faster. Such a change in at least one of the air flow orientation and air velocity minimizes the risk of excessive cooling or heating largely deviating from the set temperature Ts around the air conditioners 21 to 24, 26 to 29 in operation.

(5-6)

In the case where the compressor 45 of the air conditioner 25, for example, is stopped when the air conditioning capacity falls within a predetermined range for at least two of a plurality of air conditioners 21 to 29, the air conditioner 25 whose compressor 45 is stopped is switched to perform a blowing operation, so as to facilitate shifting of air in the room RM which is the air-conditioning-target space. This reduces the uneven temperature distribution attributed to the stoppage of the compressor 45 which is the part of the compressors, and minimizes the risk of excessive cooling or heating deviating largely from the set temperature Ts around the air conditioners 21 to 24, 26 to 29 in operation.

(5-7)

In stopping firstly the compressor 41 of the air conditioner 21, for example, when the air conditioning capacity falls within a predetermined range for at least two of a plurality of air conditioners 21 to 29, any (for example, the air conditioner 29) of the air conditioners 24 to 29 having their compressors 42 to 49 in operation and the air conditioner 21 whose compressor 41 is stopped are replaced by each other after a lapse of a predetermined time. Thus, the place with a smaller number of air conditioners in operation (around the air conditioner 21) and the place with a greater number of air conditioners in operation (for example, around the air conditioner 29) are replaced by each other. This reduces the uneven temperature distribution attributed to stoppage of part of the compressors.

(5-8)

The plurality of air conditioners 21 to 29 are a plurality of in-group air conditioners which are grouped and communicate with one another. Through the communication among the plurality of in-group air conditioners, the air conditioner whose compressor is to be stopped when the air conditioning capacity falls within a predetermined range for at least two of the plurality of air conditioners 21 to 29 is selected. Therefore, setting of the air conditioners for changing the number of the air conditioners for example newly adding an air conditioner to the air-conditioning-target space or removing an air conditioner from the grouped air conditioners can be simply performed by grouping the air conditioners using a remote controller or the like.

REFERENCE SIGNS LIST

10: air conditioning system
21 to 29: air conditioner
30: system control unit
41 to 49: compressor
210: air-conditioning-target-space-side heat exchanger (exemplary service-side heat exchanger)
220: common-space-side heat exchanger (exemplary heat-source-side heat exchanger)

CITATION LIST

Patent Literature

Patent Literature 1: Japanese Unexamined Patent Application Publication No. S48-2756

The invention claimed is:

1. An air conditioning system configured to exchange heat, in order to condition air of one indoor air-conditioning-target space, with air of an attic disposed around the air-conditioning-target space and separated from the air-conditioning-target space, the air conditioning system comprising a plurality of air conditioners each including:

a service-side heat exchanger configured to exchange heat between air of the air-conditioning-target space and refrigerant, a heat-source-side heat exchanger configured to exchange heat between the air of the attic and the refrigerant, and a compressor whose operation frequency is variable, the compressor being configured to compress the refrigerant circulating through the service-side heat exchanger and the heat-source-side heat exchanger; and a controller that is capable of performing control, according to an air conditioning capacity of at least two of the plurality of air conditioners, so that at least one of the air conditioners whose compressors are in operation has its compressor stopped, and the at least one air conditioner having its compressor stopped is switched to an operation of using a fan to circulate air within the air-conditioning-target space.

2. The air conditioning system according to claim 1, wherein when at least two of the plurality of air conditioners collectively have an air conditioning capacity falling within a predetermined range, the at least one air conditioner has its compressor stopped and each of the air conditioners whose compressor is still in operation has an operating frequency of its compressor raised to an operation frequency improving energy consumption efficiency of the plurality of air conditioners.

3. The air conditioning system according to claim 2, wherein each of the air conditioners whose compressor is still in operation has an operation operating frequency of its compressor adjusted so as to reduce total power consumption of the compressors still in operation.

4. The air conditioning system according to claim 2, wherein each of the air conditioners whose compressor is still in operation has an operating state of the air conditioner changed so as to reduce a temperature change around the air conditioners whose compressors are still in operation.

5. The air conditioning system according to claim 1, wherein when at least two of the plurality of air conditioners collectively have an air conditioning capacity falling within a predetermined range, the at least one air conditioner has its compressor stopped and each of the air conditioner whose compressor is still in operation has an operation operating frequency of its compressor adjusted so as to reduce total power consumption of the compressors still in operation.

6. The air conditioning system according to claim 5, wherein when at least two of the plurality of air conditioners collectively have an air conditioning capacity falling within a predetermined range, the at least one air conditioner has its compressor stopped and each of the air conditioner whose compressor is still in operation has an operating state of the air conditioner changed so as to reduce a temperature change around the air conditioners whose compressors is are still in operation.

7. The air conditioning system according to claim 1, wherein when at least two of the plurality of air conditioners collectively have an air conditioning capacity falling within a predetermined range, the at least one air conditioner has its compressor stopped and each of the air conditioners whose compressor is still in operation has an operating state of the air conditioner changed so as to reduce a temperature change around the air conditioners whose compressors are still in operation.

8. The air conditioning system according to claim 7, wherein each of the air conditioners whose compressor is still in operation has at least one of an air flow orientation and air velocity of the air conditioner changed so as to reduce a temperature change around the air conditioners whose compressor are still in operation.

9. The air conditioning system according to claim 8, wherein after at least one air conditioner has its compressor stopped, when at least two of the plurality of air conditioners collectively have an air conditioning capacity falling within a predetermined range, the controller switches which air conditioner's compressor is in operation and which air conditioner's compressor is stopped.

10. The air conditioning system according to claim 7, wherein after the at least one air conditioner has its compressor stopped, when at least two of the plurality of air conditioners collectively have an air conditioning capacity falling within a predetermined range, the controller switches which air conditioner's compressor is in operation and which air conditioner's compressor is stopped.

11. An air conditioning system configured to exchange heat, in order to condition air of one indoor air-conditioning-target space, with air of a common space disposed indoors around the air-conditioning-target space and not being a target of the air conditioning, the air conditioning system comprising a plurality of air conditioners each including:

a service-side heat exchanger configured to exchange heat between air of the air-conditioning-target space and a refrigerant, a heat-source-side heat exchanger configured to exchange heat between the air of the common space and the refrigerant, and a compressor configured to compress the refrigerant circulating through the service-side heat exchanger and the heat-source-side heat exchanger, wherein the plurality of air conditioners include a plurality of in-group air conditioners grouped to establish communication with one another, and a controller that is capable of performing control so that, when at least two of the plurality of air conditioners have an air conditioning capacity falling within a predetermined range for at least two of the plurality of air conditioners, at least one of the air conditioners whose compressors are still in operation is selected to have its compressor stopped through the communication among the plurality of in-group air conditioners, and the at least one air conditioner has it compressor stopped.

12. An air conditioning system configured to exchange heat, in order to condition air of one indoor air-conditioning-target space, with air of an attic disposed around the air-conditioning-target space and separated from the air-conditioning-target space, the air conditioning system comprising a plurality of air conditioners each including:

a service-side heat exchanger configured to exchange heat between air of the air-conditioning-target space and a refrigerant, a heat-source-side heat exchanger configured to exchange heat between the air of the attic and the refrigerant, and a compressor whose operation frequency is variable, the compressor being configured to compress the refrigerant circulating through the service-side heat exchanger and the heat-source-side heat exchanger; and a controller that is capable of performing control, according to an air conditioning capacity of at least two of the plurality of air conditioners, so that at least one of the air conditioners whose compressors are in operation has its compressor stopped, and the plurality of air conditioners include a plurality of in-group air conditioners grouped to establish communication with one another, and the at least one air conditioner is selected through the communication among the plurality of in-group air conditioners.

13. The air conditioning system according to claim 12, wherein when at least two of the plurality of air conditioners collectively have an air conditioning capacity falling within a predetermined range, the at least one air conditioner has its compressor stopped and each of the air conditioners whose compressor is still in operation has an operating frequency of its compressor raised to an operation frequency improving energy consumption efficiency of the plurality of air conditioners.

14. The air conditioning system according to claim 12, wherein when at least two of the plurality of air conditioners collectively have an air conditioning capacity falling within a predetermined range, the at least one air conditioner has it compressor stopped and each of the air conditioners whose compressor is still in operation has an operation operating frequency of its compressor adjusted so as to reduce total power consumption of the compressors still in operation.

15. The air conditioning system according to claim 12, wherein when at least two of the plurality of air conditioners collectively have an air conditioning capacity falling within a predetermined range, the at least one air conditioner has its compressor stopped and each of the air conditioners whose compressor is still in operation has an operating state of the air conditioner changed so as to reduce a temperature change around the air conditioners whose compressors is are still in operation.

* * * * *